US009275514B2

(12) United States Patent
Kelly et al.

(10) Patent No.: US 9,275,514 B2
(45) Date of Patent: Mar. 1, 2016

(54) SYSTEM AND METHOD FOR PROVIDING A SYSTEM GENERATED IN-GAME BONUS IN A GAMING ENVIRONMENT

(75) Inventors: Bryan Kelly, Alamo, CA (US); Theordore Keenan, Castro Valley, CA (US); Kiran Brahmandam, Fremont, CA (US); Martin Lyons, Las Vegas, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 884 days.

(21) Appl. No.: 13/290,360

(22) Filed: Nov. 7, 2011

(65) Prior Publication Data

US 2012/0142409 A1 Jun. 7, 2012

Related U.S. Application Data

(63) Continuation-in-part of application No. 12/792,466, filed on Jun. 2, 2010, now Pat. No. 8,342,948.

(60) Provisional application No. 61/412,888, filed on Nov. 12, 2010.

(51) Int. Cl.

| | |
|---|---|
| ***A63F 9/24*** | (2006.01) |
| ***G07F 17/32*** | (2006.01) |
| ***G07F 17/34*** | (2006.01) |

(52) U.S. Cl.

CPC ..... *G07F 17/3244* (2013.01); *G07F 17/34* (2013.01)

(58) Field of Classification Search

CPC ..... G07F 17/3244; G07F 17/3255; G07F 17/3258

USPC ..... 463/16–20, 25

See application file for complete search history.

(56) References Cited

U.S. PATENT DOCUMENTS

| | | | | |
|---|---|---|---|---|
| 7,704,145 | B2 * | 4/2010 | Glisson et al. | 463/25 |
| 7,727,061 | B2 * | 6/2010 | Taylor | 463/16 |
| 8,157,641 | B2 * | 4/2012 | Englman et al. | 463/25 |
| 8,353,762 | B2 * | 1/2013 | Rodgers et al. | 463/27 |
| 2002/0147083 | A1 * | 10/2002 | Wilson | 482/139 |
| 2004/0039637 | A1 * | 2/2004 | Kopf et al. | 705/14 |
| 2007/0015564 | A1 * | 1/2007 | Walker et al. | 463/16 |
| 2008/0108425 | A1 * | 5/2008 | Oberberger | 463/25 |
| 2008/0306820 | A1 * | 12/2008 | Passmore | 705/14 |
| 2009/0124333 | A1 * | 5/2009 | Nelson et al. | 463/20 |
| 2011/0111826 | A1 * | 5/2011 | Baerlocher et al. | 463/20 |
| 2011/0111828 | A1 * | 5/2011 | Caputo et al. | 463/20 |
| 2011/0117995 | A1 * | 5/2011 | Vallejo et al. | 463/20 |
| 2011/0117996 | A1 * | 5/2011 | Rommerdahl et al. | 463/20 |
| 2011/0281625 | A1 * | 11/2011 | Moody | 463/13 |
| 2012/0052935 | A1 * | 3/2012 | Vancura et al. | 463/20 |
| 2012/0115560 | A1 * | 5/2012 | Moody | 463/13 |

OTHER PUBLICATIONS

Rouse, Margaret, "One-to-one-marketing (1:1 marking)", Whats.com, first published Mar. 2007.*

* cited by examiner

*Primary Examiner* — Michael Cuff

(74) *Attorney, Agent, or Firm* — Marvin A. Hein; Philip J. Anderson

(57) ABSTRACT

A gaming system, terminal and method where a bonus is derived from multiple sources including system based and local sources and is delivered to a gaming machine by providing one or more additional game(s), altered games or altered features at the gaming machine instead of a direct award of the prize. The gaming system, terminal and method also provides for selection between various game features with different expected values for delivery of the bonus.

25 Claims, 13 Drawing Sheets

SYSTEM AND METHOD FOR PROVIDING A SYSTEM GENERATED IN-GAME BONUS IN A GAMING ENVIRONMENT

CROSS-REFERENCE TO RELATED APPLICATION

This application is a non-provisional filing of U.S. provisional application Ser. No. 61/412,888 filed Nov. 12, 2010 and is a continuation-in-part application to co-pending U.S. patent application Ser. No. 12/792,466 filed Jun. 2, 2010 and titled "System, Apparatus and Method for Saving Game State and for Utilizing Game States on Different Gaming Devices".

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND OF THE INVENTION

1. Field of the Invention

The field of the invention relates to systems and methods for issuing bonuses to players of gaming terminals.

2. Description of the Related Art

Modernly gaming terminals include not only a base or primary game but one or more bonus games and/or special features. These features may be triggered randomly or may be triggered by the player obtaining one or more outcomes from the base game. For example a player may receive a special symbol(s) triggering a feature of free games, a bonus game or some other feature. These bonus features are designed into the game and the award structure for the bonus or feature is accounted for when determining the theoretical payback percentage for the game, i.e. the theoretical payback to the player for each unit wagered. For example the base game may have a theoretical payback of 80% with the bonus feature having a theoretical payback (equivalent value based upon payback and bonus feature hit frequency) contributing another 15% yielding a game having an overall payback percentage of 95%. Bonus features such as sets of free games, or a "pick a prize" bonus or a spinning wheel game have equivalent values which contribute to the payback percentage for the game. Depending upon the base game payback, the hit frequency for the feature game, i.e. the probability that during any spin of the base game the feature game will be triggered, and the feature game payback the overall payback percentage for the game can be crafted as desired or required.

Players tend to gravitate toward their favorite games. Perhaps a player likes the game theme or has had past success with the game or enjoys the various feature games. The player becomes familiar with the game features and understands the play characteristics of their favorite games.

In regards to casino play, and in the future it is anticipated Internet or mobile telephone or personal data assistant (PDA) wagering, operators drive player loyalty in one respect through system-provided bonusing. The casino (or gaming network) includes a communication network by which an operator can monitor player activity such as wagers, jackpots, games played and the like. Players are identified typically thought the player's use of a loyalty card having a machine readable stripe. For a brick and mortar casino an example of such a system is the Bally CMS® system sold by Bally Technologies, Inc. of Las Vegas, Nev. These systems interface with card readers at gaming terminals and table game input devices to provide the aforesaid tracking functions. Based upon the data collected the casino can provide benefits and incentives to retain a player's loyalty by, for example, awarding "comps" in the form of cash back, discounts for goods and services and gifts. The tracking can be restricted to a single venue or can be on a national basis such as described in Boushy, U.S. Pat. No. 7,419,427 issued Sep. 2, 2008 and titled "NATIONAL CUSTOMER RECOGNITION SYSTEM AND METHOD", the disclosure of which is incorporated by reference. The level of "comps" available to the player is related to the player's rating which quantifies the value of the player to the casino. A higher rated player is one who spends and gambles more than a lower rated player. A higher rated player is entitled to more valuable or additional comps.

Using the network system-provided bonusing can be crafted using the network to assemble funds by allocation of a percentage of player wagers at gaming terminals connected to the network to a pool. When the pool reaches a trigger amount, for example, all or a portion of the pool is awarded awarding to the player whose contribution caused the trigger value to be met or exceeded. These types of bonuses are often referred to a "Mystery jackpots" since they are awarded typically as a result of a system configuration and the basis for the award is a mystery to the player since it has nothing to do with the outcome received on the player's gaming terminal.

The system-provided bonuses have heretofore been delivered by directly awarding cash or credits to the player at the gaming terminal or to the player's electronic account from which the player may download credits for play. Thus the bonus is delivered as cash or its equivalent. It would be advantageous if the system-provided, bonus could be delivered through a feature, enhanced feature or additional feature of the game being played by the player. This would increase the entertainment value of the bonus as well as enhance the player's loyalty to the game they are playing. It would also be advantageous if different funds could be sourced for the system-provided bonus such as comps or points earned from food and beverage, lodging, gift shop, spa or golf purchases as well as funds donated from other sources. In this regard it would be advantageous if the casino or a third party could brand the bonus to provide an additional form of advertising. It would further be advantageous if a player, who is entitled to a bonus of a certain value, could elect to receive the bonus as an additional or enhanced feature of the game they are playing.

SUMMARY OF THE INVENTION

There is provided according to embodiments of the present invention a system and method for funding and issuing a bonus to a user of a gaming terminal such as a gaming machine presenting a game having play and award features. The system and method includes the funding of a plurality of fund pools having values $V_1$-$V_N$. These fund pools may have various sources throughout the system enterprise. For example, where the enterprise is a casino-resort enterprise of one or more venues, a server may be provided which communicates with the casino slot accounting and player tracking system to fund a pool as a percentage of the money wagered at the gaming machines. Other servers may be configured to generate pools as contributions from spending for food and beverages, lodging, casino services such as golf or spa or the spending at gift shops as well as a pool derived from a contribution of marketing dollars by the casino or a third party.

These pools may be represented by currency value, e.g. dollars, or may be represented by "points" (a value related scalar subject to redemption for value according to certain rules). Points or dollars available for bonusing may come from other sources within or outside the enterprise such as from a third party marketing partner or the like.

A server is provided which accesses the various pool server sources to convert all or a portion of the funds into a common bonus "enterprise currency" amount available for bonusing according to predetermined rules. For example, if the patron has earned 100 points based upon their gift shop spending, those points may be converted to have an enterprise currency value of $20 for bonusing. Another rule is that the player, based upon their "rating", may only be entitled to a certain bonus during any period, e.g. limited to one or aggregate bonuses of a certain value such a $100 per day.

Based upon satisfaction of established bonus triggering criteria a bonus is made available to the player of a gaming machine. The bonus triggering criteria may be when the bonus pool(s) reach an amount, random triggering of the bonus, pseudo-random triggering of the bonus, random triggering of the bonus where probabilities are weighted in favor of the player's favorite games or favorite machines, a command by the system operator to issue a bonus or the like. When the bonus is triggered the available bonus value in enterprise currency dollars is made available for the gaming terminal. For example, the gaming terminal may have a feature that where the player obtains certain symbol combinations in the base game the player is entitled to ten free spins. When the free spin feature is triggered the gaming terminal may query the system to determine if a bonus has been made available. If not the gaming terminal plays the ten free spins according to the normal, configuration of the terminal. If a bonus is available the gaming terminal may dispense the bonus by (1) adding a number of free games having an expected value related to the bonus value, (2) or providing a multiplier for the ten free games or (3) providing the free spins where the distribution of symbols on one or more reels is altered (or wild symbols added or substituted for symbols) to increase the expected value from the free spins to in effect configure the gaming terminal to render the awarded bonus to the player through the player recognized game play base game, bonus or game feature. Since the outcomes of the bonus rendering features cannot be determined, the expected value for the feature configuration is selected so that the award of the bonus is mathematically supported. In other words, a bonus of $10 may be delivered though a feature where the player selects from a set of icons representing undisclosed features and that on average the expected return to the player would be $10. In practice the player may select a $5 prize or a $20 prize but based upon probabilities and over time the selected bonus amount will be awarded to players.

The bonus may also be delivered through the base game by providing play based upon reels where the symbol distribution is altered from the base game configuration to increase the expected value of one or more successive spins for the player or to increase the probabilities of winning by, for example, using reconfigured reels, e.g. substituting wild symbols, additional scatter symbols or the like. Additionally or alternatively the bonus may be delivered by, where the player has triggered a feature from the base game, an additional feature game that is offered through which the player may receive the bonus.

The delivery of the bonus through the game may be branded. For example where a provider or third party wishes to advertise they may fund a pool. When the bonus is triggered, a new feature game may be presented to the player with the game branded or having a theme which advertises the provider's goods or services. Where, for example, a third party airline company provides bonusing funds, the feature game may have a travel theme with aircraft bearing the company's logo.

After the bonus is issued it is deducted from the pool(s). The deduction from the pools may be based upon a configured hierarchy or protocol.

The bonus may be delivered through configuration of the gaming terminal or through the system. Upon triggering of the bonus the system may deliver content to the gaming terminal in the form of a game which is displayed at the gaming terminal display or auxiliary display.

Where the gaming terminal (or system) has game features through which the bonus will be delivered with different expected values e.g. $EV_1$ and $EV_2$ and the bonus value calls for an expected value between $EV_1$ and $EV_2$ the system and method also provides for selection of the feature though which the bonus will be delivered so that overall the expected value and feature characteristics over time delivers the desired bonus amount to the player.

Other features and numerous advantages of the various embodiments will become apparent from the following detailed description when viewed in conjunction with the corresponding drawings.

DETAILED DESCRIPTION OF THE PREFERRED EMBODIMENTS

The present invention is broadly directed to providing one or more bonuses to players of gaming terminals which can be funded from one or a plurality of funding sources. These funding sources may be in different unitary values meaning that their redemption value available for bonusing may be different for different fund sources. The present invention normalizes these funding sources into a common enterprise value for bonusing. This feature provides a resort with the ability to construct a resort-wide accrual and redemption criteria based upon the commercial activity of a player-user as well as pools funded from sources such as donations, marketing dollars or third party funding. Additionally it permits the casino resort to add new funding sources without overhauling their existing system.

The present invention is also directed to a system and method for the delivery of a bonus to a user. The delivery is through the use or enhancement of an in-game feature or bonus with which a player is familiar and/or a branded feature. For example, if a player playing a base or primary slot machine terminal game which triggers a free game feature, the player may normally be entitled to ten free games paid at a 1× multiplier. If the player is entitled to a bonus according to the present invention the player may now instead be awarded fifteen free games or the same ten free games at a 2× pay multiplier. Thus a system derived bonus is delivered by incorporating the bonus into recognized or enhanced features of the game rather than simply a credit award. It is thought that such a technique increases the entertainment value of the game as well as fostering a favorable player impression about the game. To develop loyalty with the casino the bonus may be branded as being provided by the casino (or a third party who may be at least partially funding the bonus).

Other features and advantages of the present invention will be described including, but not limited to, bonus triggering, bonus configuration, bonus timing and renditions of the bonus award at the gaming terminal.

Gaming Terminal

Figure 1:
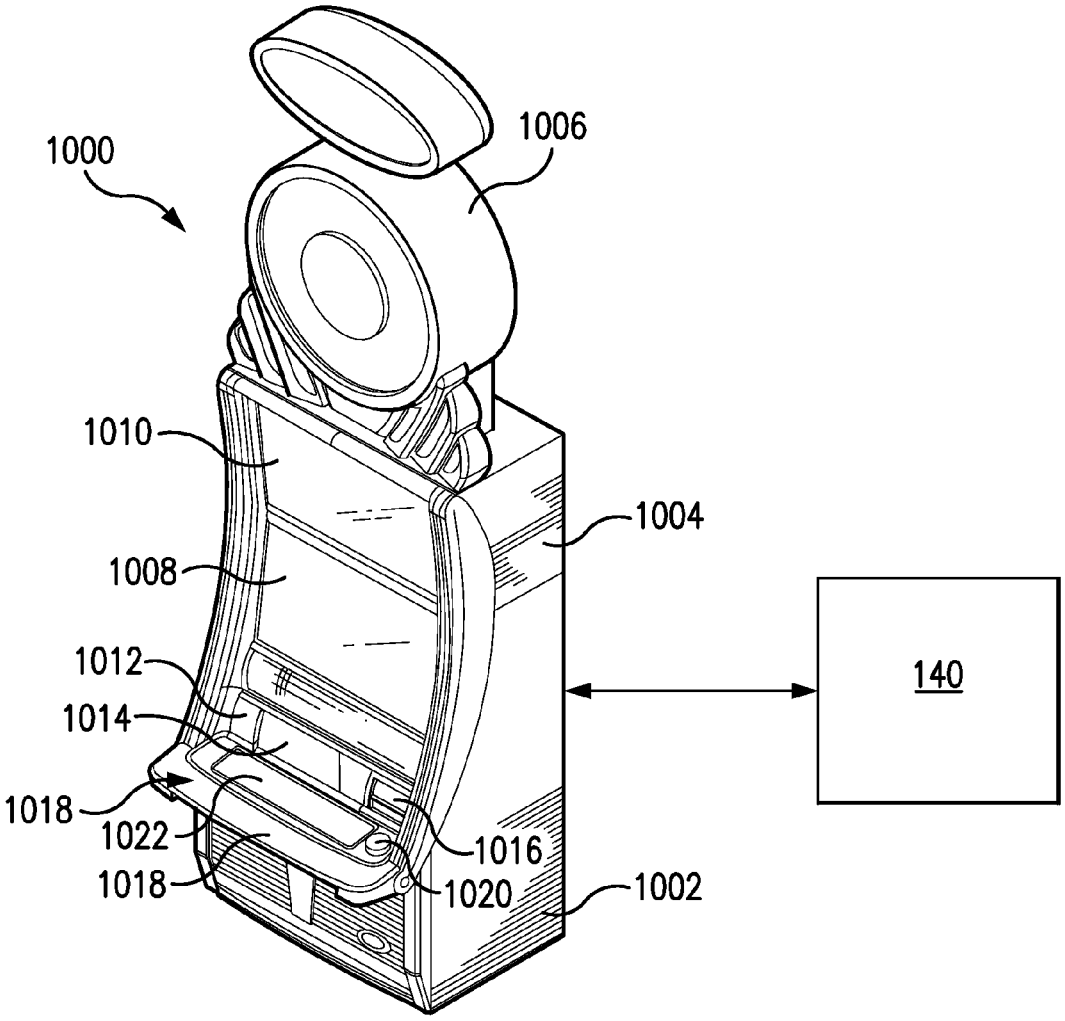
FIG. 1 illustrates a gaming terminal connected to a network.

Turning to the drawings FIG. 1 illustrates an example of a gaming terminal 1000 which may be utilized according to the various embodiments of the present invention. While the gaming terminal 1000 is shown as a video based game it should be understood that the terminal 1000 could be an electro-mechanical stepper game, video Poker game, video Keno game, Class II gaming terminal, a sports wagering terminal for making wagers on sporting events such as horse racing or football, a terminal for server based gaming or a terminal supporting the downloading of games to the terminal 1000 or a stand-alone multi-game terminal, a PC terminal or mobile device for providing gaming content and player interaction to make a wager upon a proposition, receive or report an outcome and to issue an award to the player in the event the outcome is favorable.

The gaming terminal 1000 includes a cabinet 1002 housing the various components. The terminal 1002 includes a top box 1004 as well. A topper 1006 includes lights and backlit printed panels to attract players to the terminal 1000. The cabinet 1004 supports a main game display 1008 which may be a CRT, LCD, OLED or other electronic video display. Alternatively the main game display 1008 may be a window for viewing electro-mechanical stepper reels as is known in the art. The cabinet 1002 and more particularly its top box 1004 support a secondary display 1010. The secondary display 1010 may be a backlit printed glass or plastic panel or may be a display of the type described in reference to the main game display 1008. The main game display 1008 is positioned to display primary content to the player such as a game. The secondary display 1010 typically displays additional content such as information about the game, e.g. game name and associated graphics and pay table but may also display other content such as a bonus game or, in combination with the main game display 1008, a common game or bonus game display. It should be understood that the displays could display other content such as advertising, sports or other programming or the like. It should be understood that the main game display 1008 and secondary display 1010 could be embraced by a single display position in a portrait mode or the like.

The gaming device 1000 also includes a gaming system interface 1012 which has a display 1014 and the slot 1016 for receiving and reading a player identification instrument such as a machine readable player tracking card. The interface 1012 includes a device of the player to interface with the system such as a keypad or touch sensitive input display.

A user interface 1018 is provided to enable the player to interact with the gaming device 1000. The interface 1018 includes one or more displaceable buttons 1020. The interface 1018 may include a touch screen panel 1022 to display gesture activated buttons (not shown) in addition to any displaceable buttons 1020. By a "displaceable" button 1020 what is meant is a mechanical button which can be physically displaced by sliding, rotating, rocking, depressing or the like to enter an interface input. As part of the interface 1012 or as a separate component a cushioned hand rest 1024 may also be provided.

The gaming terminal 1000 is configured to have a base game such as a video spinning reel game. Based upon the symbol distribution (virtual or actual) and the award schedule for designated winning outcomes the base game will have a certain payback. By that what is meant is that for every dollar theoretically wagered the player should receive back in winnings a certain percentage, e.g. 85%. The game for the gaming terminal 1000 may also have certain bonus features triggered for example by the player receiving one or more triggering symbols during the play of the base game. The feature may consist of (i) free spins of the game, (ii) free spins of the game with winning outcomes multiplied by a multiplier, (iii) a feature game such as offering the player selections to reveal a prize, (iv) play of a secondary game such as one where a game piece is moved to reveal prizes, (v) the random selection of one or more awards or (vi) play or another game such as a roulette, dice or card game to reveal a prize. The type of feature games which can be incorporated are only limited by the imagination of the game designers and the desired performance parameters for the game such as the minimum and maximum payback percentages. If a base game has an 85% payback percentage, the feature hit (trigger) frequency and payback from the bonus features must also be taken into account to determine the overall payback percentage for the game. Thus it should be understood for the purposes of the present invention that the game features have equivalent values (EV) which are the expected (theoretical) return for a unit wagered. Expected value (or expectation) for the purposes of this invention should be understood to mean sum of the probability of each possible outcome of the experiment multiplied by its payoff ("value"). In many respects the equivalent value is the same as the expected payback percentage. For example, if the game had a roulette game feature having 38 numbers and if the unit of wager is \$1 and the winning pay if the player has the randomly selected number is 35:1 then the expected value for the feature is $1-[(-\$1\times\text{odds of losing}=\frac{37}{38})+(\$35\times\text{odds of winning of }\frac{1}{38})]=0.9474$. Thus the expected value for the Roulette game is, for each unit wagered, 0.9474. This expected value is known for the base game (payback percentage) as well as for each feature game. If the base game has a payback percentage of 85% (0.85) and the feature game is the roulette game described above but it is only triggered theoretically on 5% of the base game spins then the overall payback for the game is $85\%+(5\%\times0.9474)=85\%+4.737\%\approx89.7\%$ game. Based upon the foregoing it should be understood that each of the base game and its various features has an expected value (payback percentage) and for a feature or bonus a probability of being triggered. It should also be understood that a feature game can be triggered by base game symbols or by a non-symbol based trigger such as described in Olive, U.S. Pat. No. 7,056,215 (a lottery approach is used to trigger a feature prize) the disclosure of which is incorporated by reference.

The gaming terminal 1000 is connected to and in communication with one or more systems 140. As hereinafter described the systems may be include slot management and player loyalty functionalities as are known in the art. For example the slot management system may be the Bally CMS® system sold by Bally Technologies, Inc. of Las Vegas, Nev.

Figure 2A:
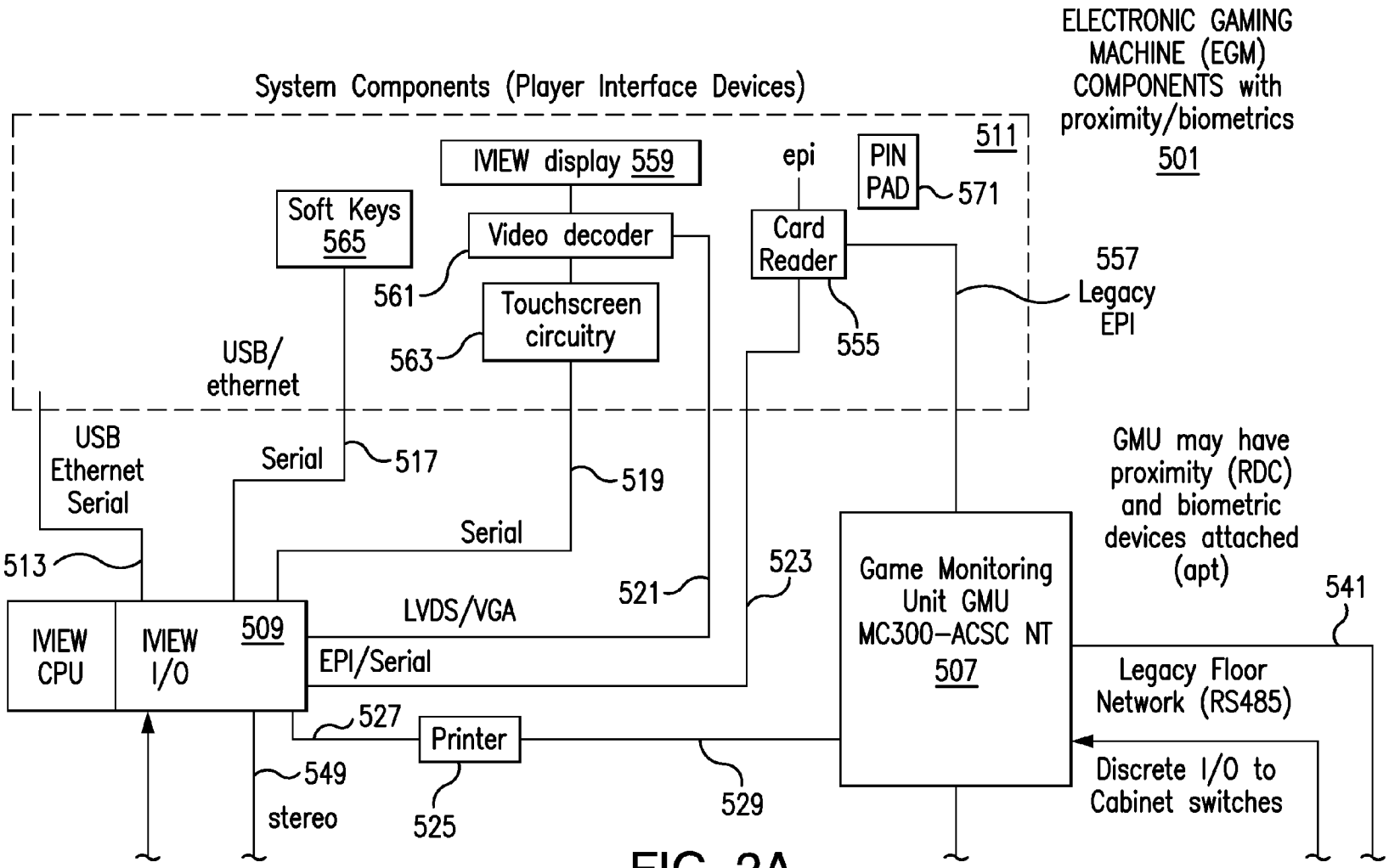
FIGS. 2A-B illustrate an example of a gaming machine operational platform and components for a gaming terminal of the type of the present invention.
Figure 2B:
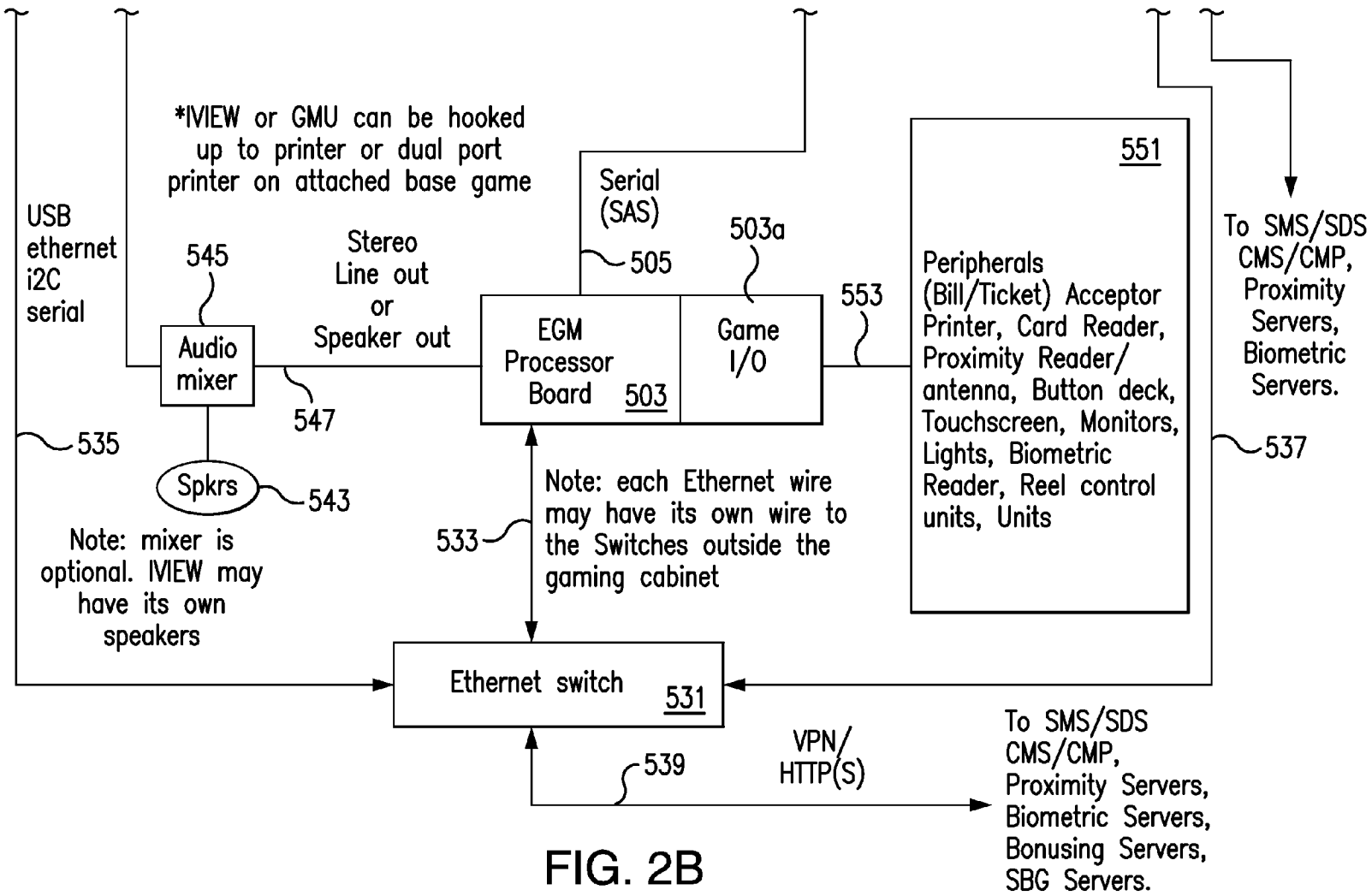

Turning to FIGS. 2A and B the gaming device 1000 hardware 501 for its various controller(s) is shown for purposes of illustration. The hardware 501 includes base game integrated circuit board 503 (EGM Processor Board) connected through serial bus 505 to game monitoring unit (GMU) 507 (such as a Bally MC300 or ACSC NT), and player interface integrated circuit board (PIB) 509 connected to player system interface devices 511 over buses 513, 517, 519, 521, 523. Gaming voucher ticket printer 525 (for printing player cash out tickets) is connected to PIB 509 and GMU 507 over buses 527, 529. EGM Processor Board 503, PIB 509, and GMU 507 connect to Ethernet switch 531 over buses 533, 535, 537. Ethernet switch 531 connects to a slot management system (SMS) and a casino management system (CMS) network over bus 539. Ethernet switch 531 may also connect to a server based gaming server or a downloadable gaming server. GMU 507 also may connect to the SMS and CMS network over bus 541. Speakers 543 produce sounds related to the game or according to the present invention connect through audio mixer 545 and buses 547, 549 to EGM Processor Board 503 and PIB 509.

Peripherals 551 connect through bus 553 to EGM Processor Board 503. The peripherals 551 include, but are not limited to the following and may include individual processing capability: bill/ticket acceptor to validate and accept currency and ticket vouchers, player loyalty card reader, the player interfaces including features to support the touch screen/gesture functionality such as user interface 1018, main game display 1008, secondary display 1010 (with or without touch screen functionality), monitors and lights, reel control units where the gaming terminal 1000 is a stepper game and biometric reading (capturing) devices such as the digital camera 36. For example, a bill/ticket acceptor is typically connected to the game input-output board of the EGM processing board 503 (which is, in turn, connected to a conventional central processing unit ("CPU") board), such as an Intel Pentium microprocessor mounted on a gaming motherboard. The I/O board may be connected to CPU processor board by a serial connection such as RS-232 or USB or may be attached to the processor by a bus such as, but not limited to, an ISA bus. The gaming motherboard may be mounted with other conventional components, such as are found on conventional personal computer motherboards, and loaded with a game program which may include a gaming machine operating system (OS), such as a Bally Alpha OS. EGM processor board 503 executes a game program that causes the gaming terminal 1000 to display and play a game. The various components and included devices may be installed with conventionally and/or commercially available components, devices, and circuitry into a conventional and/or commercially available gaming terminal cabinet 1002, examples of which are described above.

When a player has inserted a form of currency such as, for example and without limitation, paper currency, coins or tokens, cashless tickets or vouchers, electronic funds transfers or the like into the currency acceptor, a signal is sent by way of bus 553 to the I/O board and to EGM processor board 503 which, in turn, assigns an appropriate number of credits for play in accordance with the game program. The player may further control the operation of the gaming terminal 1000 by way of other peripherals 551, for example, to select the amount to wager via a player interface such as the button panel 1018. The game starts in response to the player operating a start mechanism such as a handle, button such as a SPIN/RESET button touch screen icon or depressing button 1020. The game program includes a random number generator to provide a display of randomly selected indicia on one or more of the main and/or secondary displays 1008, 1010. In some embodiments, the random number generator may be physically separate from gaming terminal 1000; for example, it may be part of a central determination host system which provides random game outcomes to the game program. Finally, processor board 503 under control of the game program and OS compares the final display of indicia to a pay table. The set of possible game outcomes may include a subset of outcomes related to the triggering of a feature or bonus game. In the event the displayed outcome is a member of this subset, processor board 503, under control of the game program and by way of I/O Board 553, may cause feature game play to be presented on the main/secondary display(s) 1008, 1010.

Predetermined payout amounts for certain outcomes, including feature game outcomes, are stored as part of the game program. Such payout amounts are, in response to instructions from processor board 503, provided to the player in the form of coins, credits or currency via I/O board and a pay mechanism, which may be one or more of a credit meter, a coin hopper, a voucher printer, an electronic funds transfer protocol or any other payout means known or developed in the art.

In various embodiments, the game program is stored in a memory device (not shown) connected to or mounted on the gaming motherboard. By way of example, but not by limitation, such memory devices include external memory devices, hard drives, CD-ROMs, DVDs, and flash memory cards. In an alternative embodiment, the game programs are stored in a remote storage device. In one embodiment, the remote storage device is housed in a remote server such as a downloadable gaming server. The gaming terminal 1000 may access the remote storage device via a network connection, including but not limited to, a local area network connection, a TCP/IP connection, a wireless connection, or any other means for operatively networking components together. Optionally, other data including graphics, sound files and other media data for use with the gaming terminal 1000 are stored in the same or a separate memory device (not shown). Some or all of the game program and its associated data may be loaded from one memory device into another, for example, from flash memory to random access memory (RAM).

In one or more embodiments, peripherals may be connected to the system over Ethernet connections directly to the appropriate server or tied to the system controller inside the gaming terminal 1000 using USB, serial or Ethernet connections. Each of the respective devices may have upgrades to their firmware utilizing these connections.

GMU 507 includes an integrated circuit board and GMU processor and memory including coding for network communications, such as the G2S (game-to-system) protocol from the Gaming Standards Association, Las Vegas, Nev., used for system communications over the network. As shown, GMU 507 may connect to a player card reader 555 through bus 557 and may thereby obtain player card information and transmit the information over the network through bus 541. Gaming activity information may be transferred by the EGM Processor Board 503 to GMU 507 where the information may be translated into a network protocol, such as S2S, for transmission to a server, such as a player tracking server, where information about a player's playing activity may be stored in a designated server database.

PID 509 includes an integrated circuit board, PID processor, and memory which includes an operating system, such as Windows CE, a player interface program which may be executable by the PID processor together with various input/output (I/O) drivers for respective devices which connect to PID 509, such as player interface devices 511, and which may further include various games or game components playable on PID 509 or playable on a connected network server and PID 509 is operable as the player interface. PID 509 connects to card reader 555 through bus 523, player system interface display 24 through video decoder 561 and bus 521, such as an LVDS or VGA bus.

As part of its programming, the PID processor executes coding to drive system interface display 1014 and provide messages and information to a player. Touch screen circuitry 563 interactively connects display 1014 and video decoder 561 to PID 509; such that a player may input information and cause the information to be transmitted to PID 509 either on the player's initiative or responsive to a query by PID 509. Additionally soft keys 565 connect through bus 517 to PID 509 and operate together with the display 1014 to provide information or queries to a player and receive responses or queries from the player. PID 509, in turn, communicates over the CMS/SMS network through Ethernet switch 531 and busses 535, 539 and with respective servers, such as a player tracking server.

Player interface devices 511 are linked into the virtual private network of the system components in gaming terminal 1000. The system components include the iVIEW® device ('iView" is a registered trademark of Bally Gaming, Inc.) processing board and game monitoring unit (GMU) processing board. These system components may connect over a network to the slot management system (such as a commercially available Bally SDS/SMS) and/or casino management system (such as a commercially available Bally CMP/CMS).

The GMU system component has a connection to the base game through a serial SAS connection and is connected to various servers using, for example, HTTPs over Ethernet. Through this connection, firmware, media, operating system software, gaming machine configurations can be downloaded to the system components from the servers. This data is authenticated prior to install on the system components.

In an alternative embodiment the player system interface including the display 1014 may instead be presented, upon command or request by the player, as a portion of the main display 1008. Where the main display 1008 has touch screen functionality, upon command or requests the content at the main game display 1008 such as a video reel game display is sized to accommodate a player interface display panel at the main game display 1008. The touch screen functionality for the main game display 1008 is configured to enable the player to interface with the interface through touch screen controls (buttons, sliders, arrows, etc.).

Figure 3:
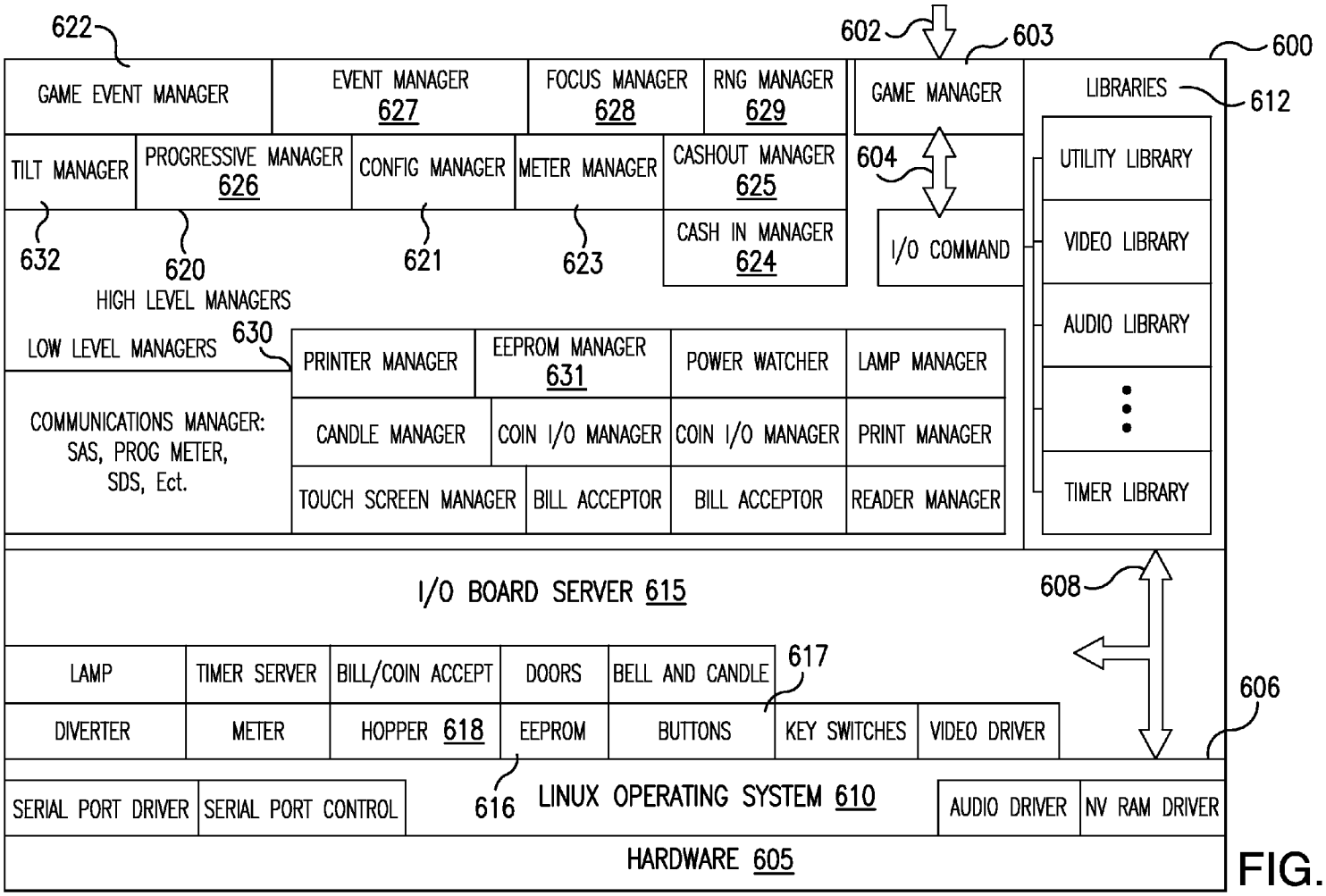
FIG. 3 is a block diagram of the logical components of a gaming kernel for a gaming terminal.

Turning to FIG. 3 is a functional block diagram of a gaming kernel 600 of a game program under control of processor board 503, uses gaming kernel 600 by calling into application programming interface (API) 602, which is part of game manager 603. The components of game kernel 600 as shown in FIG. 3 are only illustrative, and should not be considered limiting. For example, the number of managers may be changed, additional managers may be added or some managers may be removed without deviating from the scope and spirit of the invention.

As shown in the example, there are three layers: a hardware layer 605; an operating system layer 610, such as, but not limited to, Linux; and a game kernel layer 600 having game manager 603 therein. In one or more embodiments, the use of a standard operating system 610, such a UNIX-based or Windows-based operating system, allows game developers interfacing to the gaming kernel to use any of a number of standard development tools and environments available for the operating systems. This is in contrast to the use of proprietary, low level interfaces which may require significant time and engineering investments for each game upgrade, hardware upgrade, or feature upgrade. The game kernel layer 600 executes at the user level of the operating system 610, and itself contains a major component called the I/O Board Server 615. To properly set the bounds of game application software (making integrity checking easier), all game applications interact with gaming kernel 600 using a single API 602 in game manager 603. This enables game applications to make use of a well-defined, consistent interface, as well as making access points to gaming kernel 600 controlled, where overall access is controlled using separate processes.

For example, game manager 603 parses an incoming command stream and, when a command dealing with I/O comes in (arrow 604), the command is sent to an applicable library routine 612. Library routine 612 decides what it needs from a device, and sends commands to I/O Board Server 615 (see arrow 608). A few specific drivers remain in operating system 610's kernel, shown as those below line 606. These are built-in, primitive, or privileged drivers that are (i) general (ii) kept to a minimum and (iii) are easier to leave than extract. In such cases, the low-level communications is handled within operating system 610 and the contents passed to library routines 612.

Thus, in a few cases library routines may interact with drivers inside operating system 610, which is why arrow 608 is shown as having three directions (between library utilities 612 and I/O Board Server 615, or between library utilities 612 and certain drivers in operating system 610). No matter which path is taken, the logic needed to work with each device is coded into modules in the user layer of the diagram. Operating system 610 is kept as simple, stripped down, and common across as many hardware platforms as possible. The library utilities and user-level drivers change as dictated by the game cabinet or game machine in which it will run. Thus, each game cabinet or game machine may have an industry standard processor board 503 connected to a unique, relatively dumb, and as inexpensive as possible I/O adapter board, plus a gaming kernel 600 which will have the game-machine-unique library routines and I/O Board Server 615 components needed to enable game applications to interact with the gaming machine cabinet. Note that these differences are invisible to the game application software with the exception of certain functional differences (i.e., if a gaming cabinet has stereo sound, the game application will be able make use of API 602 to use the capability over that of a cabinet having traditional monaural sound).

Game manager 603 provides an interface into game kernel 600, providing consistent, predictable, and backwards compatible calling methods, syntax, and capabilities by way of game application API 602. This enables the game developer to be free of dealing directly with the hardware, including the freedom to not have to deal with low-level drivers as well as the freedom to not have to program lower level managers 630, although lower level managers 630 may be accessible through game manager 603's interface 602 if a programmer has the need. In addition to the freedom derived from not having to deal with the hardware level drivers and the freedom of having consistent, callable, object-oriented interfaces to software managers of those components (drivers), game manager 603 provides access to a set of high level managers 620 also having the advantages of consistent callable, object-oriented interfaces, and further providing the types and kinds of base functionality required in casino-type games. Game manager 603, providing all the advantages of its consistent and richly functional interface 602 as supported by the rest of game kernel 600, thus provides a game developer with a multitude of advantages.

Game manager 603 may have several objects within itself, including an initialization object (not shown). The initialization object performs the initialization of the entire game machine, including other objects, after game manager 603 has started its internal objects and servers in appropriate order. In order to carry out this function, the kernel's configuration manager 621 is among the first objects to be started; configuration manager 621 has data needed to initialize and correctly configure other objects or servers.

The high level managers 620 of game kernel 600 may include game event log manager 622 which provides, at the least, a logging or logger base class, enabling other logging objects to be derived from this base object. The logger object is a generic logger; that is, it is not aware of the contents of logged messages and events. The log manager's 622 job is to log events in non-volatile event log space. The size of the space may be fixed, although the size of the logged event is typically not. When the event space or log space fills up, one embodiment will delete the oldest logged event (each logged event will have a time/date stamp, as well as other needed information such as length), providing space to record the new event. In this embodiment, the most recent events will thus be found in the log space, regardless of their relative importance. Further provided is the capability to read the stored logs for event review.

In accordance with one embodiment, meter manager 623 manages the various meters embodied in the game kernel 600. This includes the accounting information for the game machine and game play. There are hard meters (counters) and soft meters; the soft meters may be stored in non-volatile storage such as non-volatile battery-backed RAM to prevent loss. Further, a backup copy of the soft meters may be stored in a separate non-volatile storage such as EEPROM. In one embodiment, meter manager 623 receives its initialization data for the meters, during start-up, from configuration manager 621. While running, the cash in 624 and cash out 625 managers call the meter manager's 623 update functions to update the meters. Meter manager 623 will, on occasion, create backup copies of the soft meters by storing the soft meters' readings in EEPROM. This is accomplished by calling and using EEPROM manager 631.

Progressive manager 626 manages progressive games playable from the game machine. Event manager 627 is generic, like log manager 622, and is used to manage various gaming device events. Focus manager 628 correlates which process has control of various focus items. Tilt manager 632 is an object that receives a list of errors (if any) from configuration manager 621 at initialization, and during game play from processes, managers, drivers, etc. that may generate errors. Random number generator manager 629 is provided to allow easy programming access to a random number generator (RNG), as a RNG is required in virtually all casino-style (gambling) games. RNG manager 629 includes the capability of using multiple seeds.

A credit manager object (not shown) manages the current state of credits (cash value or cash equivalent) in the game machine, including any available winnings, and further provides denomination conversion services. Cash out manager 625 has the responsibility of configuring and managing monetary output devices. During initialization, cash out manager 625, using data from configuration manager 621, sets the cash out devices correctly and selects any selectable cash out denominations. During play, a game application may post a cash out event through the event manager 627 (the same way all events are handled), and using a call back posted by cash out manager 625, cash out manager 625 is informed of the event. Cash out manager 625 updates the credit object, updates its state in non-volatile memory, and sends an appropriate control message to the device manager that corresponds to the dispensing device. As the device dispenses dispensable media, there will typically be event messages being sent back and forth between the device and cash out manager 625 until the dispensing finishes, after which cash out manager 625, having updated the credit manager and any other game state (such as some associated with meter manager 623) that needs to be updated for this set of actions, sends a cash out completion event to event manager 627 and to the game application thereby. Cash in manager 624 functions similarly to cash out manager 625, only controlling, interfacing with, and taking care of actions associated with cashing in events, cash in devices, and associated meters and crediting.

In a further example, in accordance with one or more embodiments, I/O server 615 may write data to the gaming machine EEPROM memory, which is located in the gaming machine cabinet and holds meter storage that must be kept even in the event of power failure. Game manager 603 calls the I/O library functions to write data to the EEPROM. The I/O server 615 receives the request and starts a low priority EEPROM thread 616 within I/O server 615 to write the data. This thread uses a sequence of 8 bit command and data writes to the EEPROM device to write the appropriate data in the proper location within the device. Any errors detected will be sent as IPC messages to game manager 603. All of this processing is asynchronous.

In accordance with one embodiment, button module 617 within I/O server 615, polls (or is sent) the state of buttons at the user interface 1018 every two milliseconds. These inputs are debounced by keeping a history of input samples. Certain sequences of samples are required to detect a button was pressed, in which case the I/O server 615 sends an inter-process communication event to game manager 603 that a button was pressed or released. In some embodiments, the gaming machine may have intelligent distributed I/O which debounces the buttons, in which case button module 617 may be able to communicate with the remote intelligent button processor to get the button events and simply relay them to game manager 603 via IPC messages. In still another embodiment, the I/O library may be used for pay out requests from the game application. For example, hopper module 618 (where a coin/token hopper is provided) must start the hopper motor, constantly monitor the coin sensing lines of the hopper, debounce them, and send an IPC message to the game manager 603 when each coin is paid.

Further details, including disclosure of lower level fault handling and/or processing, are included in U.S. Pat. No. 7,351,151 entitled "Gaming Board Set and Gaming Kernel for Game Cabinets" and provisional U.S. patent application number 60/313,743, entitled "Form Fitting Upgrade Board Set For Existing Game Cabinets," filed Aug. 20, 2001; said patent and provisional are both fully incorporated herein by explicit reference.

System Components

Figure 4:
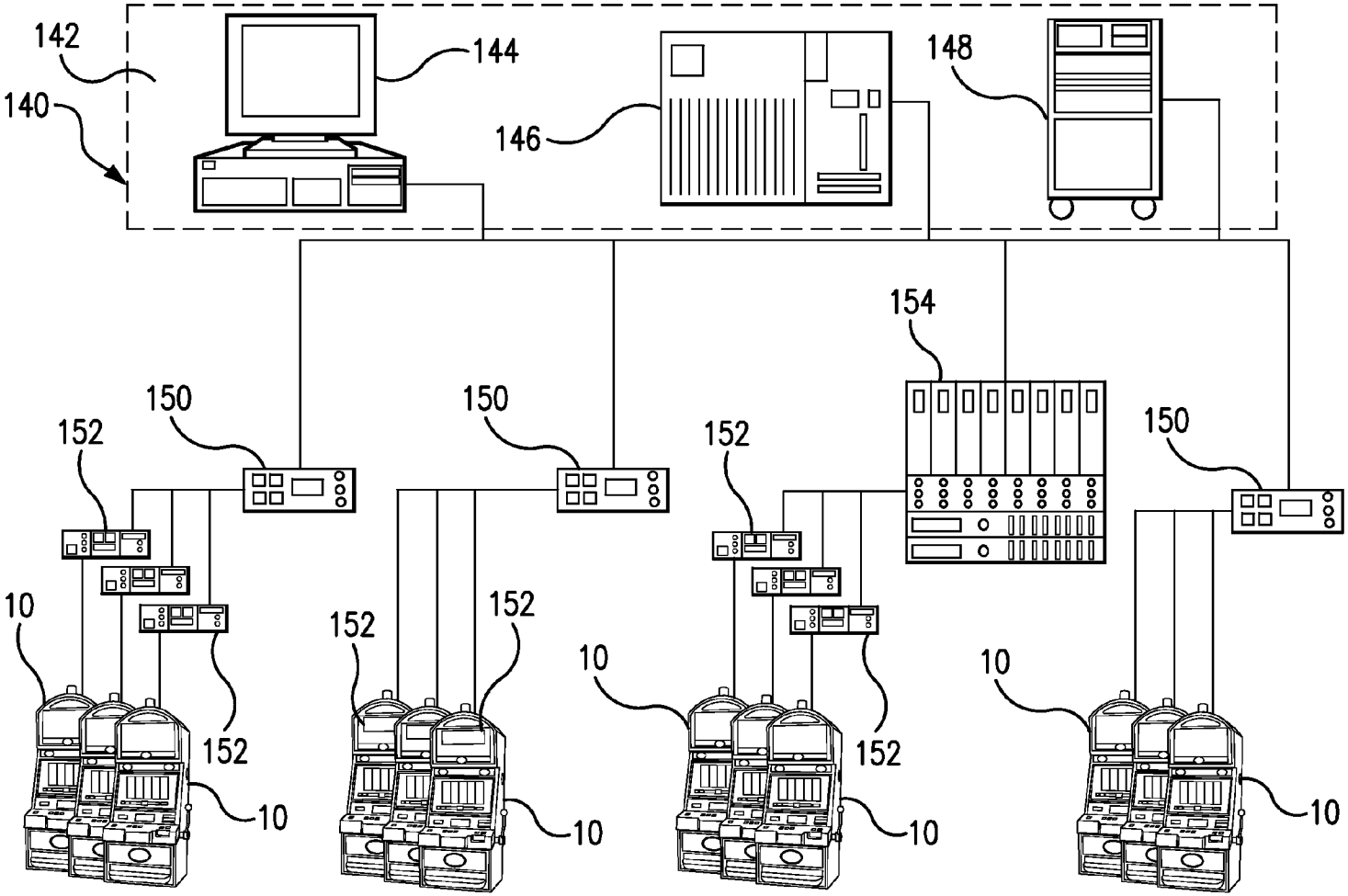
FIG. 4 is a schematic of an example of a network incorporating gaming terminals.

FIG. 4 illustrates an example of a casino gaming system 140 that may include one or more gaming terminals 1000 and some servers. As will become evident more or fewer servers may interface with the system. The casino gaming system 140 comprises one or more gaming terminals 1000. The gaming terminals 1000 illustrated in FIG. 4 act as terminal devices for interacting with a player playing a casino game. Networking components facilitate communications between a backend system 142 and game management units 152 that control displays for banks of gaming terminals 1000 across a network. Game management units (GMU's) 152 connect gaming terminals 1000 to networking components and may be installed in the gaming terminal cabinet 1002 or external to the gaming terminal 1000. The function of the GMU 152 is similar to the function of a network interface card connected to a desktop personal computer (PC). Some GMU's 152 have much greater capability and can perform such tasks as presenting and playing a game using a display (not shown) operatively connected to the GMU 152. In one embodiment, the GMU 152 is a separate component located outside the gaming terminal 1000. Alternatively, in another embodiment, the GMU 152 is located within the gaming terminal 1000 as the user interface 1012 (FIG. 1). Optionally, in an alternative embodiment, one or more gaming terminals 1000 connect directly to a network and are not connected to a GMU 152.

The gaming terminals 1000 are connected via a network to a network bridge 150, which is used for networking, routing and polling gaming devices, including slot machines. The network bridge 150 connects to a back end system 142. Optionally, the gaming terminals 10 may connect to the network via a network rack 154, which provides for a few numbers of connections to the back end system 142. Both, network bridge 150 and network rack 154 may be classified as middleware, and facilitate communications between the back end system 142 and the GMUs 152. The network bridges 150 and network rack 154 may comprise data repositories for storing network performance data. Such performance data may be based on network traffic and other network related information. Optionally, the network bridge 150 and the network rack 154 may be interchangeable components. For example, in one embodiment, a casino gaming system may comprise only network bridges and no network racks. Alternatively, in another embodiment, a casino gaming system may comprise only network racks and no network bridges. Additionally, in an alternative embodiment, a casino gaming system may comprise any combination of one or more network bridges and one or more network racks.

The back end system 142 may be configured to comprise one or more servers as hereinafter described. The type of server employed is generally determined by the platform and software requirements of the gaming system. In one embodiment, as illustrated in FIG. 4, the back end system 142 is configured to include three servers: a slot floor controller 144, a casino management server 146 and a casino database 148. As described with reference to FIG. 5 the casino resort enterprise may include other servers. The slot floor controller 144 is a part of the player tracking system for gathering accounting, security and player specific information. The casino management server 146 and casino database 148 work together to store and process information specific to both employees and players. Player specific information includes, but is not limited to, passwords, biometric identification, player card identification, and biographic data. Additionally, employee specification information may include biographic data, biometric information, job level and rank, passwords, authorization codes and security clearance levels.

Overall, the back end system 142 performs several functions. For example, the back end system 142 can collect data from the slot floor as communicated to it from other network components, and maintain the collected data in its database. The back end system 142 may use slot floor data to generate a report used in casino operation functions. Examples of such reports include, but are not limited to, accounting reports, security reports, and usage reports. The back end system 142 may also pass data to another server for other functions. Alternatively, the back end system 142 may pass data stored on its database to floor hardware for interaction with a game or game player. For example, data such as a game player's name or the amount of a ticket being redeemed at a game may be passed to the floor hardware. Additionally, the back end system 142 may comprise one or more data repositories for storing data. Examples of types of data stored in the system server data repositories include, but are not limited to, information relating to individual player play data, individual game accounting data, gaming terminal accounting data, cashable ticket data, sound data, and optimal display configurations for one or more displays for one or more system game.

Of course, one will appreciate that a gaming system 140 may also comprise other types of components, and the above illustrations are meant only as examples and not as limitations to the types of components or games used in a casino gaming system.

Figure 5:
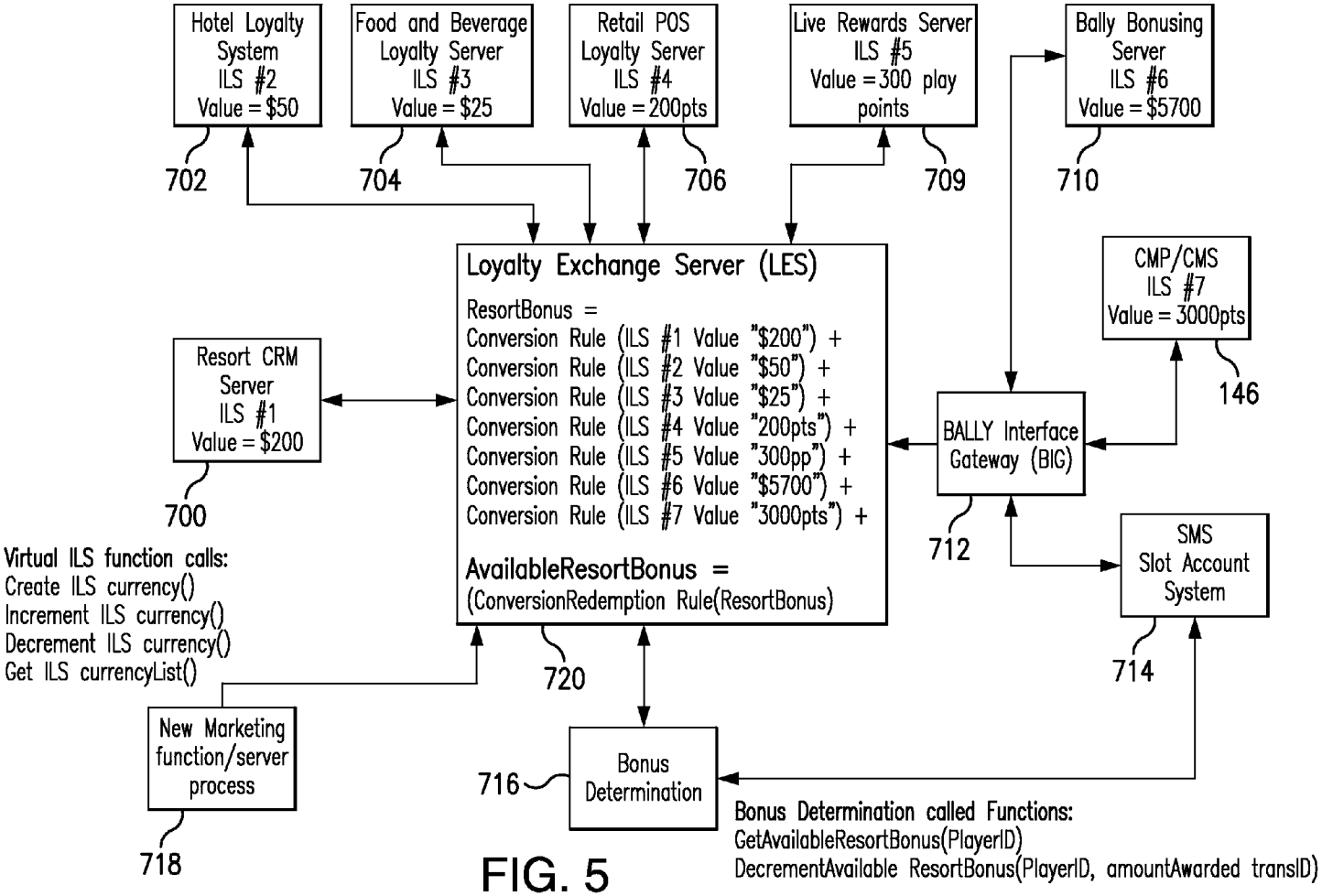
FIG. 5 is a diagram showing a relationship between an exchange server and other resort servers according to an embodiment of the system and method of the present invention.

FIG. 5 illustrates an example of the sourcing of funds for bonusing according to the present invention across an enterprise such as a casino resort. According to an embodiment of the present invention there is provided a loyalty exchange server 720. The loyalty exchange server is provided to assemble data and bonus pools from one of a plurality of what may be existing servers throughout the enterprise for bonusing according to this embodiment of the present invention. At 700 is a resort customer relationship marketing (CRM) individual loyalty server (ILS). As shown the resort may use marketing dollars or funds provided by the third party to fund bonuses for individual or groups of players. In the example shown for a hypothetical player, the casino has made $200 available for bonusing a player according to the present invention. The amount available for a player may depend upon the player's rating, i.e. value to the enterprise based at least in part upon the player's gaming activities. The player's activities may also define the player's loyalty club rating. For example a player may be ranked as a Diamond, Gold or Silver rated player. Depending upon the player's ranking he/she is entitled to additional benefits. It should be noted that all or a portion of the amount of the player's bonus at the CRM loyalty server 700 may be available at any time. Further, if desired, a portion of the amount may be available for bonusing or redemption other than through a bonus delivered according to the present invention such as through redemption for goods or services. The value at the server may be in terms of dollars or points or other reference amount. The player would be identified at the CRM loyalty server by, for example, their issued player loyalty card or other identifier such as biometric identification.

The enterprise may also have a hotel loyalty server 702 which is configured to accrue a bonus pool value based upon the player's hotel "spend" such as for lodging. The value associated to the player may again be in terms of a monetary unit, points or other reference amount. A food and beverage loyalty server 704 and retail point of sale (POS) server 706 likewise accrue bonus value funds (or points) based upon the player's commercial activity with those enterprise business units. To provide the association of the activity to a player the player would in most cases be identified such as by using a player loyalty card, their name or other identification means. Additionally or alternatively the player may be identified by biometric devices such as facial recognition, fingerprint recognition or other biometric identifier.

The loyalty exchange server 720 is also placed in communication with, for this example, a Bally Rewards® server 708 which retains a value amount associated with the player which may be used for wagering on system provided games displayed, for example, on the player user interface 1012. This value may be provided from marketing dollars or as a portion of the player's wagering or enterprise spend. A Bally Bonusing™ Server 710 may also be provided at the enterprise to accrue and/or retain funds available for system mystery bonusing, for example. These funds may be from donated marketing dollars or accrued as a portion of the player's wagering and/or other enterprise spend. Another possible source of bonus funds according to the system and method of the present invention is the value from the CMS/SMS server 146. This value is typically accrued based upon the player's gambling spend with the enterprise. Again the player would be identified by the servers as described above through their loyalty card, biometric identification, PIN (personal identification number) or other identification instrument In FIG. 5 there is shown an interface gateway 712 which is in communication with the CMS/SMS server 146, slot account system (SMS) server 714, the loyalty exchange server 712 and the gaming terminals 1000 as hereinafter described. The interface gateway 712 permits the loyalty exchange server 720 to communicate with the Bally Bonusing™ Server 710, CMS/SMS server 146 and SMS server 714 inasmuch as the same may communicate according to different messaging protocols.

Functionally cooperating with the loyalty exchange server 720 is a bonus determination software engine 716 which retrieves the available bonus according to the present invention from the loyalty exchange server 720 and through the slot accounting server 714 makes the bonus available to the interface gateway 712 and from there the gaming terminals 1000. At 718 is the marketing server which interfaces with the loyalty exchange server 720 to establish, as hereinafter described, bonus currency conversion rules, decrementing rules (the order in which pools are decremented for a bonus and in what amounts), incrementing rules as well as recording pool value histories. Enterprise personnel access the marketing server 718 to establish and change rules and retrieve records.

Figure 6:
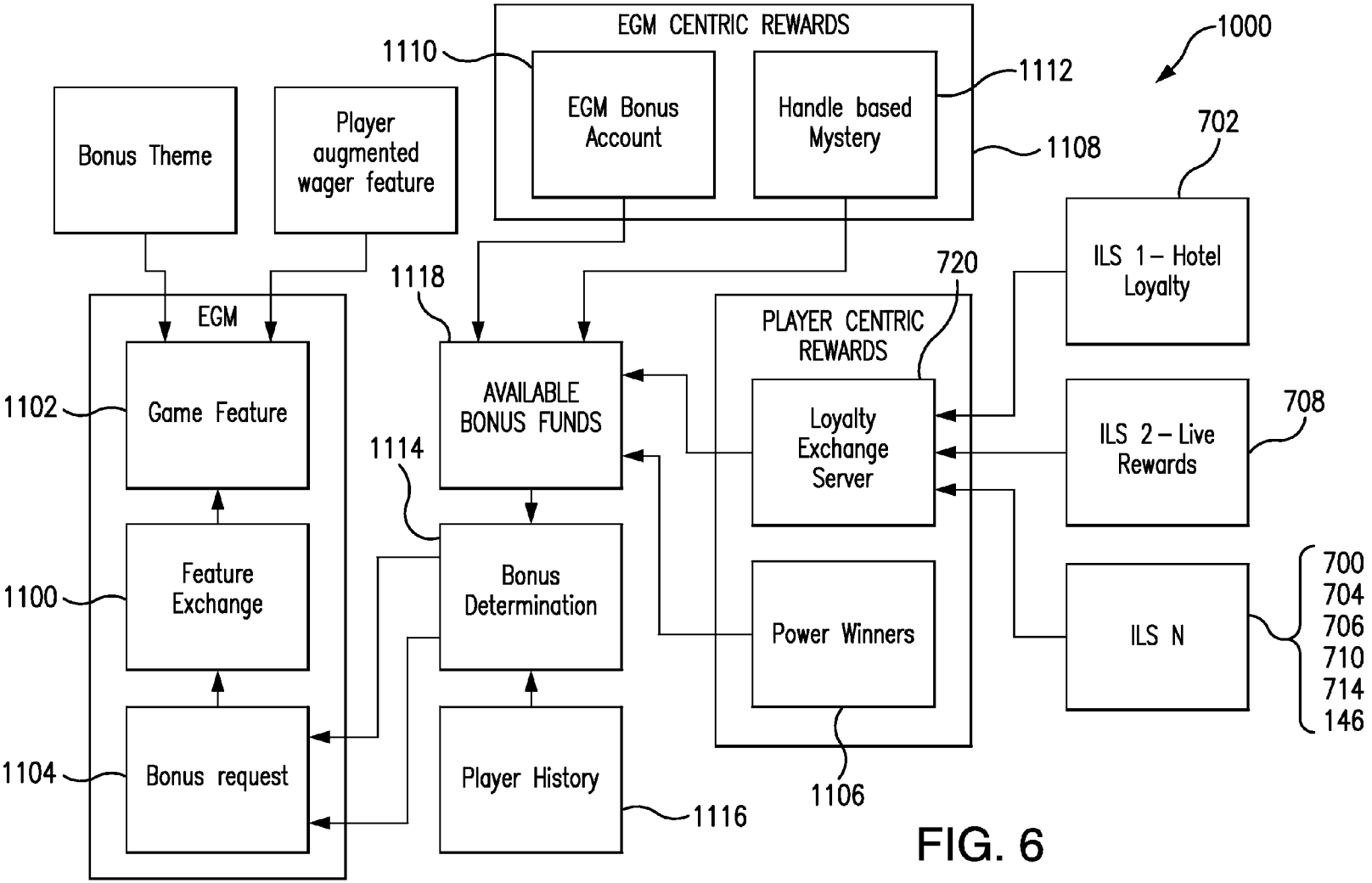
FIG. 6 is a diagram for the bonusing system and method according to the present invention.

FIG. 6 illustrates the functions related to the system and method of the present invention. The gaming terminal 1000 (EGM) is shown which functionally includes a feature exchange 1100 which stores data representing the various features which are available to the game such as a package of free spins of the base game or a separate bonus game. Each feature in the feature exchange 1100 library has an equivalent value EV associated therewith and, where the feature is normally triggered during play of the base game, an associated hit rate R, the probability of having the feature awarded. The hit rate R may be configured in the base game where the feature trigger is a symbol-based trigger, i.e. based upon the player obtaining one or a combination of symbols from a spin or play of the base game. It should be noted that there may be features in the library which can be externally triggered such as by the system and method of the present invention as hereinafter described or which may be triggered by other than symbols or symbol combinations of the base game. In this case R would be based upon the probability of triggering the feature from the non-symbol based event. Depending upon the feature selected from the library to deliver the bonus at 1102 the feature is presented to the player for execution.

While the description herein is directed to a feature being triggered from a base game (or non-symbol based trigger occurring as a result of the play of a base game) a feature can also be triggered from a feature game. For example, from a play of the base game the player may have won a chance to play a spinning wheel game (feature game 1) where one of the stops represents a trigger for ten free spins of the base game (feature game 2). The determination of R for feature game 2 would take into account R for triggering feature game 1 as well as the odds for triggering feature game 2 during the play of feature game 1.

The gaming terminal 1000 includes software/firmware configured to issue a bonus request 1104. This bonus request may be based upon gaming terminal operations (internal) such as a symbol combination of the base game triggering a feature or an internal configuration such as triggering a bonus request 1104 after a certain number of plays, losses or the like or a mystery trigger such as the type described in Olive, U.S. Pat. No. 7,056,215. As stated above the bonus request may also be triggered external to the gaming terminal 1000 by a system or link command such as a system mystery jackpot trigger such as described in Kelly et al, U.S. Pub. 2008/0305864 titled "POWER WINNERS PROCESSING SYSTEM", the disclosure of which is incorporated by reference.

The bonus request 1104 is in bilateral communication with the bonus determination server 716 via the interface gateway 712. According to this embodiment the bonus request 1104 issues a message requesting if a bonus is available to be awarded from the bonus determination server 1114. If a bonus is available it is provided by a message package back to the gaming terminal 1000 or is made available by appropriate messaging back to the gaming terminal 1000. The messaging would include the value of the bonus to be delivered as determined by the loyalty exchange server 720 and marketing function server 718.

To determine the available bonus funds the loyalty exchange server 720 assembles the pool values accrued from the various enterprise servers and makes a determination of the available bonus amount based upon the conversion rules set forth at the marketing function server 718. Table 1 below sets forth a hypothetical determination of the available bonus based upon some assumed pool values.

TABLE 1

| Pool Source | Amount in Pool (A) | Conversion Factor (C) | Bonus Pool Value (A × C) |
|---|---|---|---|
| Resort CRM 700 | $200 | 100% | $200 |
| Hotel Loyalty 702 | $50 | 50% | $ 25 |
| Food & Beverage 704 | $25 | 20% | $ 5 |
| Retail POS 706 | 200 Points | $1/100 | $ 2 |
| Live rewards 708 | 300 play points | $1/300 | $ 1 |
| Bally Bonusing Server 710 | $57 | 100% | $ 57 |
| CMP/CMS Server712 | 3000 points | $1/100 points | $ 30 |
| Total (Loyalty exchange Server - Converted Resort Dollars (CRD)) | | | $320 (CRD) |

As can be appreciated these various bonus pool amounts continue to increase based upon the player's commercial activity and/or contributions by the enterprise or third parties to the pools. The resort CRM 700 pool value may be increased by the enterprise with marketing dollars or by a contribution by a third party wishing to package advertising in the manner according to the present invention. The hotel loyalty server 702 retains a value for the player based upon qualifying hotel expenditures made by the player such as for lodging, room service or other room charges. For example for each $100 dollars the player spends they may accrue $5 toward the pool. Food and beverage as well as retail POS pool values are also incremented based upon the players qualifying food and beverage expenditures and retail purchases. Again the pool value may be accrued at any desired rate versus the actual dollars spent. The Live Rewards and Bally Bonusing server pools may be accrued based upon one or more of (i) a percentage of the player's wagering amounts, (ii) a percentage of the player's group (family or junket group for example) wagering or (iii) contributions from the enterprise or a third party or from other sources. These bonus pool amounts are available for bonusing by other than the method and system of the present invention but may also be accessed, if desired by the enterprise or selected by the player, for bonusing through the gaming terminal according to the present invention. Finally the CMP/CMS pool represents points accrued by the player based upon qualified waging activities. By qualified activities what is meant is that the player is identified such as by using their player loyalty card at the transaction and the transaction is not excluded from the pool. For example, certain retail point of sale transactions such as sales may be excluded as qualifying transactions.

As shown in FIG. 6 the loyalty exchange server 720 is but one possible source of funds for bonusing the player according to the system and method of the present invention. Bonuses may also be sourced from existing bonus engines such as a Power Winners™ bonus engine 1106 which provides bonuses from one or more funds and is triggered according to its own criteria as described in Kelly et al, U.S. Pub. 2008/0305864 titled "POWER WINNERS PROCESSING SYSTEM", the disclosure of which has been incorporated by reference. Other bonusing may be sourced as well such as bonuses triggered by coin-in pools reaching a certain level such as described in Tracy, U.S. Pat. No. 5,280,909 and Acres, U.S. Pat. No. 5,655,961, the disclosures of which are incorporated by reference.

An additional source of funds which can be made available for bonusing according to the present invention are terminal-centric rewards 1108 which includes an EGM (electronic gaming machine) bonus account 1110 and a handle based mystery award 1112. The EGM bonus account 1110 is derived at the gaming terminal 1000 (as opposed to a system level accumulation) by accumulating the fund based upon a percentage of each wager made. This fund is made available to the player to compensate for the player's "bad luck" by returning to the player at least a portion the fund as part of a base game or feature win when, for example, the fund reaches a certain level or the player has a number of consecutive losses or where the measured RTP (return to player) of the terminal 1000 falls below a predetermined value. The handle mystery award 1112 likewise is represented by a fund accrued from a percentage of the wagers made at the specific terminal 1000. All or a portion of the fund may be awarded back to a player based upon a mystery trigger such as where the fund reaches a certain or random amount, a mystery game such as a lottery type game as suggested in Olive, U.S. Pat. No. 7,056,215. All or a portion of these award pools may be awarded either via their own criteria or according to the system and method of the present invention. The pools may also be generated based upon the activity at a bank of gaming terminals 1000 such as a bank configured mystery jackpot in lieu of or in addition to the activity at a single gaming terminal 1000.

It should be understood that any or all of the pools referenced above have accrual and conversion criteria. Accrual criteria is the criteria which controls how the fund is accrued and from what sources. The conversion criteria are the criteria for converting the fund, which may be in dollars or points, into a common bonus dollar value, i.e. enterprise dollars, for purposes of determining the available bonus. Other criteria may affect the bonus amount available for awards such as criteria setting a maximum amount that can be awarded to a player over a certain period, e.g. a limit of $100 in bonuses during any 24-hour period, date restrictions during which the bonus can and cannot be offered, bonuses restricted to certain games or locations on the gaming floor and the like. These criteria are configurable by the establishment.

The foregoing described the sources of funds for bonusing according to the system and method of the present invention. The loyalty exchange server 720, based upon criteria established through the marketing server 718, accrues the funds. Likewise local and gaming machine bank sources may be available for bonusing. These funds accrue until depleted by a bonusing event. A bonus determination is made at 1114. This determination is made based upon the bonusing criteria such as the criteria set forth in Kelly et al, U.S. Pub. 2008/0305864 or the other references noted above or according the criteria of the present invention described herein below.

According to one embodiment of the present invention, the bonus determination 1114 is made based upon several factors some of which are player-centric and some of which are game based. As stated above the bonus determination can be made by alternative means such as a mystery trigger (where one or more pool values reach a certain amount), by the player obtaining a feature trigger during play of the gaming terminal 1000, the operator initiating the trigger, a triggering engine which randomly or pseudo-randomly issues a trigger, a drawing, a combination of the foregoing or the like. The determination according to this embodiment applies a probability factor ($F_P$) based upon the pool value to make awarding more likely to occur when the pool(s) have a higher value. For example the operator may elect to have four bonus thresholds accruing to Table 2 below.

TABLE 2

| Threshold Value | Probability factor ($F_P$) |
|---|---|
| 500 | 0.01 |
| 1000 | 0.05 |
| 10,000 | 0.2 |
| 20,000 | 0.4 |

The threshold values of Table 2 may be in Enterprise dollars (fund values×Conversion factors) or points. It will be assumed for purposes of the following description that the threshold value is in Enterprise dollars and that the bonus pool values are the aggregate pool values as opposed to individual pool values. When a bonus request is made (triggered) by the terminal 1000 (a "pull" configuration) or is triggered by the system (a "push" configuration such as a system mystery trigger) the conversion factor is used by the bonus determination 1114 software to determine if one or more players is/are eligible to receive a bonus and the amount of the award available.

Figure 7:
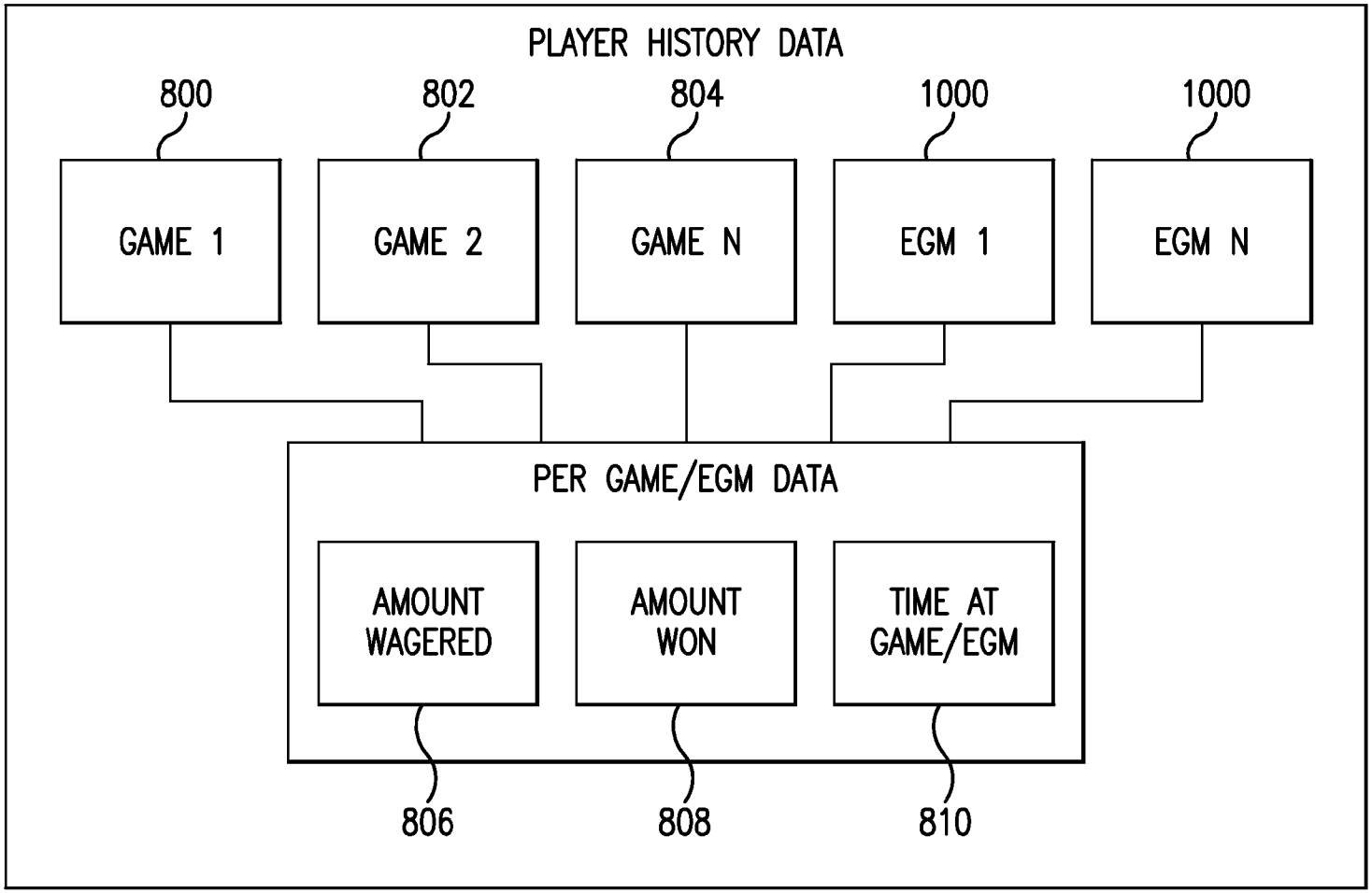
FIG. 7 is a diagram illustrating the acquisition of player history data according to one embodiment of the present invention.

In making a bonus determination a game factor (GF) is also computed. The game factor is derived from the popularity of the game a player is playing for this particular player. FIG. 7 illustrates this feature. At 1116 (FIG. 6) the CMS server 146 and CMS database 148 are accessed to retrieve data relative the this player's activity with respect to each game 800, 802, 804 played by the player including amount wagered 806, amount won 808 and time at the game 810. Table 3 provides an example of a data set for a player where the game factor is based upon the amount won (aggregated or over a predetermined time period).

TABLE 3

| Game | Amount Won |
|---|---|
| A | 100 |
| B | 250 |
| C | 20 |
| D | 800 |
| E | 160 |

If the player is currently playing Game A the game factor GF may be derived according to the following: Win for Current Game/Highest Win for a Game=Amount Won A/Amount Won D=100/800=0.125. The game factor is thus weighted toward the games the player has had the most success with to, in some respects, increase the favourable opinion for Game D and reinforce the impression that Game D is lucky for the player. The game factor may be based upon amounts wagered (aggregated or over a certain time period such as 30 days) or time at the gaming machine (again aggregate or over a predetermined time period) in a like manner. Other factors such as amount lost, largest average wager per spin/play or the like could also be used to create a weighting factor in favour of certain games.

An additional factor in the determination of whether to award a bonus is an EGM factor (EF). Rather than basing the factor on the game being player, this factor looks at the particular terminals 1000 the player has played and as a results weights the factor in favour of the terminal 1000 the player has wagered the most on, won the most on or spent the most time on. Other factors such as amount lost, largest average wager per spin/play or the like could also be used to create a weighting factor in favour of certain terminals 1000.

The game factors (GF) and EGM factors (EF) are used to generate a play factor (PF) which according to this embodiment is the larger of GF and EF. The probability factor ($F_P$) is then multiplied by the play factor PF to derive a result P. P will be less than 1 inasmuch as $F_P$ and PF and both less than 1, i.e. $0<P<1$. The operator may elect to establish a minimum and/or maximum P value depending upon whether more or less bonusing is desired. Once P is derived, a random number X is selected between 1 and 0 and if $P \leq X$ the bonus may be awarded, subject to other constraints as hereinafter described.

Once a determination has been made at 1114 the next determination is the amount of the award to be made available to a player or players at 1118. The total of the available award may be issued or a portion may be issued to provide the player with a sense that the gaming terminal 1000 has hit a "lucky streak". For example assume that the bonus is to be made available when a player triggers a feature game at their gaming terminal 1000. The available bonus funds B are determined for example B=$2600. The operator may determine that any bonus shall have a minimum value M of, for example M=$100 and that the average bonus amount A should be A=$1000. That is the operator determines that it would like to see all bonuses B $100 (Min)≤B≤$2600 (pool limit) and average toward $1000. One technique for accomplishing the foregoing would be to map bonus amounts from $100 to B, weight the map toward amounts at or near the desired average $1000 and randomly select from the mapped amounts. Another technique is to use a Gaussian distribution.

Figure 11:
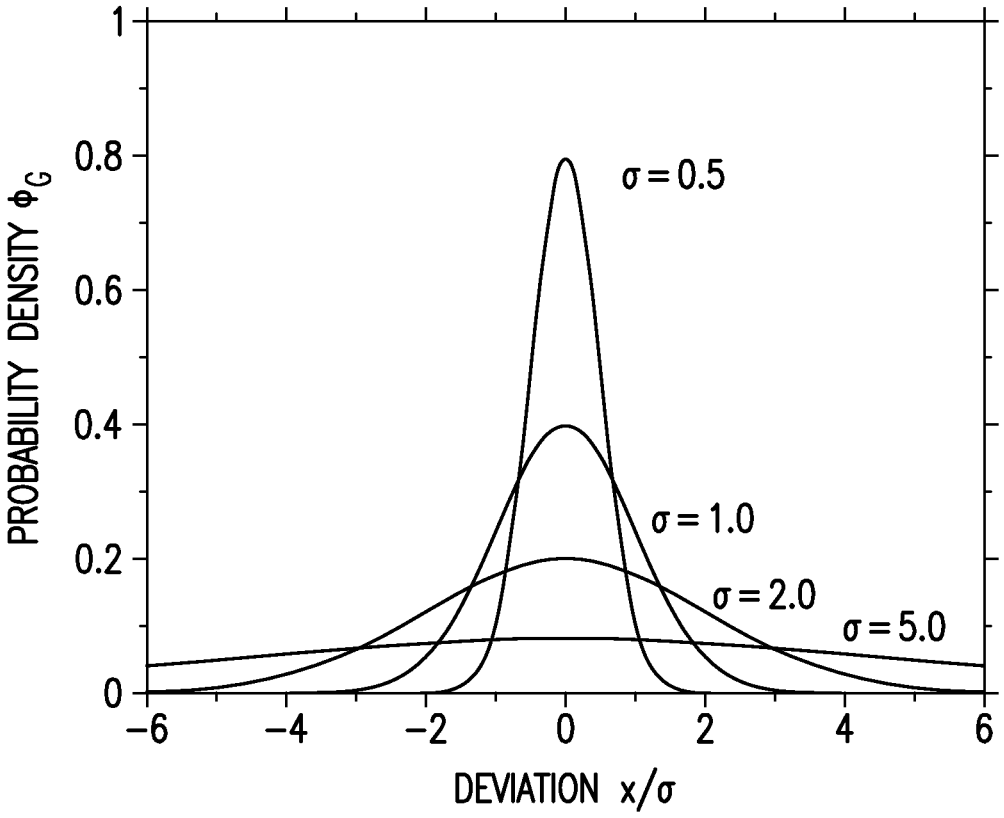
FIG. 11 is a diagram of Gaussian distributions for bonuses.

FIG. 11 shows examples of Gaussian distributions. According to this example, the average bonus A, e.g. $1000, would be associated with "0" in the Figure. By selecting the desired σ the curve can be compressed or flattened to include more or less random bonuses within ±2σ. The bonuses would also be limited by the minimum M and maximum B. Thus the majority of the bonuses will be at or slightly above or below the desired average.

There is provided a program for generating this Gaussian distribution at http://bearcave.com/misl/mis/.tech/wavelets/hurst/random.html which recites

```
float x1, x2, w, y1, y2;
    do {
        x1 = 2.0 * ranf( ) − 1.0;
        x2 = 2.0 * ranf( ) − 1.0;
        w = x1 * x1 + x2 * x2;
    } while ( w >= 1.0 );
    w = sqrt( (−2.0 * ln( w ) ) / w );
    y1 = x1 * w;
    y2 = x2 * w;
```

where ranf( ) is the routine to obtain a random number uniformly distributed in [0,1] as well as at http://www.taygeta-.com/random/gaussian.html (Taygeta Scientific Inc., 1340 Munras Ave., Suite 314, Monterey, Calif. 93940-6140)

Other methods may be used as well in determining the amount of the bonus. A simplistic technique would be to award the entire amount or where the amount exceeds some value divide it into several prizes. A random routine could be used to divide the bonus into two or more amounts as well for delivery of a single prize to a player or prizes to multiple players. Any remainder (less than a minimum prize) would remain in the pool Once a bonus amount has been determined a determination that must be made is whether the available bonus amount exceeds the permitted minimum award for the game being played by the player. For example, if the feature of the game which will deliver the bonus has a minimum award of 200 credits and the available award (or award portion) is only valued at 100 credits or the enterprise has set a minimum bonus of 100 credits; the bonus award will be aborted until next queried.

Figure 8:
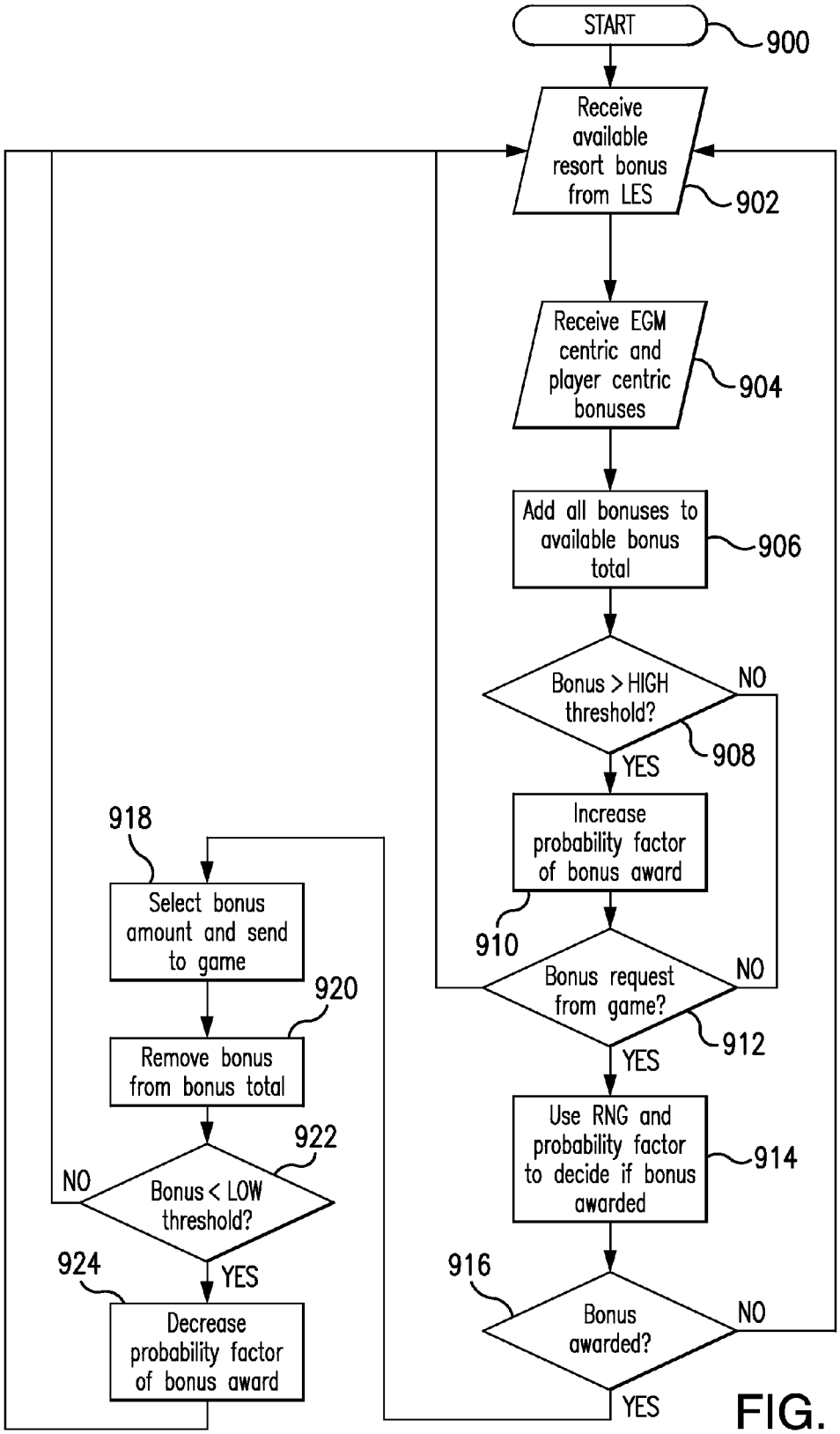
FIG. 8 is a logic diagram of a bonus determination process according to another embodiment of the present invention.

Turning to FIG. 8 a logic diagram is shown for the method and system of the present invention for selecting the probability factor $F_P$. At 900 the method/system is started and at 902 the appropriate processor such as a processor associated with the bonus determination 1114 (FIG. 6) retrieves the available bonus from the loyalty exchange server 720 and at 904 retrieves the available EGM centric awards of the EGM bonus award 1110 and the handle based mystery award 1108, if any. The available bonuses are accrued at 906. The processor, such as a processor associated with the loyalty exchange server 720, at 908 makes a determination if the available bonus is greater than a threshold value of a tier, such as the tiers of the structure of Table 2 above. If the response is in the affirmative at 910 the probability factor $F_P$ is at 912 increased to correspond to the next tier value. If the value of the available bonus(es) has not reached the next tier a determination is made at 912 if a bonus request has been made by a gaming terminal 1000 or by a system or local bonus controller. If there is no pending bonus request the method/system resumes the aggregation of the bonus pool values and determination of the applicable probability factor $F_P$.

If there is a pending bonus request at 914 the determination is made as to whether or not to award the bonus. This determination is made as described above based upon PF, the probability factor $F_P$ and the random number generator. As stated above the determination to issue a bonus can be by other means such as a coin-in mystery bonus, lottery-type bonus or the like. At 916 the bonus is either awarded or not based upon the determination. If no bonus is to be awarded the system and method resumes the aggregation of the bonus pool values and determination of the applicable probability factor $F_P$ at 902. If the determination is made to award the bonus at 918 the amount is selected as, for example, by the technique described above and is sent or made available to the game. For example, in a "pull" arrangement the EGM may request is a bonus is available such as when it triggers a feature. In a "push" arrangement the bonus may be pushed by the system to the game for implementation at the first opportunity, i.e. not interrupt normal play. At 920 the delivered bonus amount is subtracted from the available bonus pool(s) according to the configured protocol. At 922 the available bonus amount is compared to the threshold value tier amounts for the probability factor to determine whether the available bonus amount has dropped the value to a lower tier warranting the application of a lower $F_P$. If the value has decreased into a lower tier the probability factor for the lower tier is selected at 924. The system and method then return to 902 to continue to determine which probability factor to apply, whether to award the bonus and how much to award.

Figure 9:
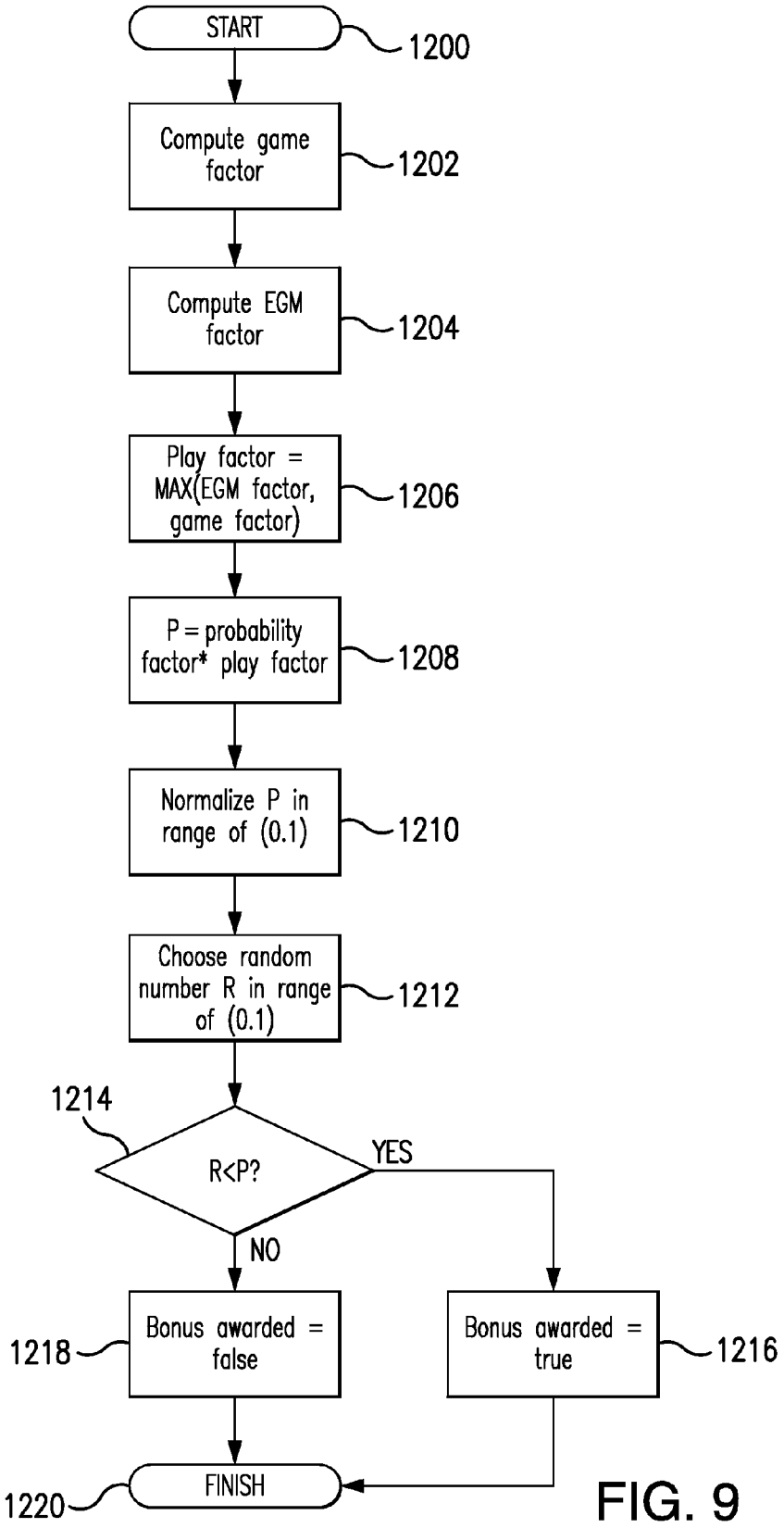
FIG. 9 is a logic diagram showing the bonus award decision process.

FIG. 9 is a logic diagram showing the method and system of the present invention for determining whether or not to issue a bonus award. At 1200 the process/system is started. The game factor GF is computed at 1202 by a suitably programmed processor associated, for example, with the loyalty exchange server 720, as is the EGM factor (EF) at 1204. At 1206 the play factor PF is determined based, according to this embodiment, on the greater of GF and EF, i.e. MAX (GF, EF). $P=F_P \times PF$ is determined at 1208 and the value of P is normalized into the range of 0.0→1.0 at 1210. The random number generator at 1212 chooses a number R within the range 0.0→1.0 and 1214 makes the comparison of R to P. If R<P then the bonus is awarded at 1216 if not at 1218 no bonus is awarded. At 1220 the process is finished.

The bonus award, selected according to the system and method of the present invention or provided by other means as described herein is called by/delivered to the game for dispensing to the player. In one embodiment, the bonus may be delivered as enhanced pays for winning combinations for the base game on a gaming terminal 1000. Accordingly, in one embodiment when the player receives a winning combination the gaming terminal would query the system to determine if a system bonus according to the present invention is available. If so and where the gaming terminal and system are configured to provide for delivery of the bonus though the base game, the terminal would "pull" the bonus from the system and reconfigure its award schedule to increase the awards for one or more winning outcomes or provide for additional winning outcomes for which a pay is received. This is referred to as a "pull" configuration since the available bonus is held by the system until the gaming terminal requests, i.e. pulls, the bonus to the terminal for distribution. The periods by which the system recalculates the available bonus may be configured, e.g. every 30 minutes, or the recalculation may be continuous until delivered. When the delivered bonus amount has been exhausted the base game returns to its original configuration. Exhaustion may be determined by delivery of the entire available bonus award or, as hereinafter described, completion of the determined bonus intervention in the game.

In an alternative embodiment when the bonus award according to the present invention is authorized the amount of the bonus is "pushed" to the gaming terminal to be delivered to the player as increased awards for winning outcomes. By pushing what is meant is that when an event occurs making a system bonus available the bonus amount is "pushed" down to the gaming terminal for distribution.

In another embodiment the bonus may be delivered (in a push or pull configuration) as an enhancement to the feature games of the gaming terminal such as by adding free games, increasing prizes, increasing the player's chances of winning a feature prize, providing additional features or the like. For example, when the player playing a base game has triggered a feature game of 10 free spins, the gaming terminal would query the system to determine if a bonus is available. If so, the bonus may be delivered to the player as a multiplier for the free games, as additional free games, as free games using reels with different symbols or symbol combinations, i.e. adding "wild" symbols, expanding "wild" symbols or the like. When a feature is triggered the bonus may be delivered through an additional feature or an existing feature with enhanced play features or awards.

As but an example, a gaming terminal may have the awards and symbol distribution to define a base game EV=0.90 (90%). Thus for a wager of $1 there would be an expected return to the player of $0.90. This game also has a free spin feature triggered by one or more base game symbol combinations. If the available bonus is $15 and the player triggers the free game bonus, the player may normally be expected to receive 5 free spins. Excluding the bonus for the $1 wager the player would mathematically expect to receive a bonus of $1×5 (free spins)×0.90 (EV)=$4.50. Of course the actual award may be more or less determined by the random outcomes (i.e. luck) of play. Now, with the bonus, the projected return to the player should be $4.50+$15=19.50. To accommodate the new amount the bonus may control the gaming terminal to either add free spins to the allotted 5 free spins or apply a multiplier. The number of free spins can be determined by: Award/(RTP×Multiplier). For example if the award is added as free spins the number of addition free spins to deliver the bonus with no multiplier would be $15/(RTP)=16.67 additional spins for a total of 21.67 free spins. Inasmuch as the total is not a whole number a random number generator could be used randomly select a number Z between 0 and 1 and if Z≤0.67 then the system would award 22 free spins otherwise the player would receive 21 free spins.

Alternatively the bonus may be configured to include a multiplier or 2× to the additional free spins resulting in a configuration of 5 free spins at 1× pay plus $15/0.9×2=8.33 free spins at 2× pay. Again since 8.33 is not a whole number of spins a random number generator could select between 8 and 9 free spins in the manner described above, i.e. if Z≤0.33 the system would award 9 additional free spins at 2× pay otherwise the player would receive 8 free spins.

The foregoing demonstrates a feature by which the system and method can accommodate issuing the bonus where the EV does not result in a whole number of free spins or where the bonus does not match a configuration of a feature. For example the game may have a feature where the player selects icons to reveal prizes. The game may have two features which differ by the award structure (AS) they offer. For example one feature may have a prize structure weighed to produce an expected prize for each $1 wagered of $EV_1$=$10 and another may have a structure where the expected value $EV_2$ is $50. During normal play the game randomly (or pseudo-randomly) selects between these features. If the determined bonus award is $23, the gaming terminal 1000 or processor associated with the loyalty exchange server 720 would randomly select a number Z between $EV_1$ and $EV_2$ and in this example if $Z \leq 23$ then the feature having $EV_2$ would be used to deliver the bonus. In this manner a gaming terminal having varying feature awards or base game configurations of different equivalent values can be used. Stated broadly where $EV_1 \leq B \leq EV_2$ where B=the bonus amount, $EV_1$ represents a feature having and award structure $AS_1$ with a first equivalent value and $EV_2$ represents a feature having an award structure $AS_2$ with a second equivalent value greater than the first (i.e. $EV_2 > EV_1$) the feature selected is determined by randomly choosing between one of EV1 and $EV_2$. Preferably where the selected random number Z is expressed $EV_1 \leq Z \leq B$ or $EV_1 \leq Z < B$ then the feature associated with $EV_2$ is employed otherwise the feature associated with $EV_1$ is used. By equivalent value what is meant is the expected pay as a result of a spin of a set of gaming terminal reels, the play of a Poker, Keno or Bingo hand or the expected value related to a feature offering a set of values to award to the player.

Figure 10A:
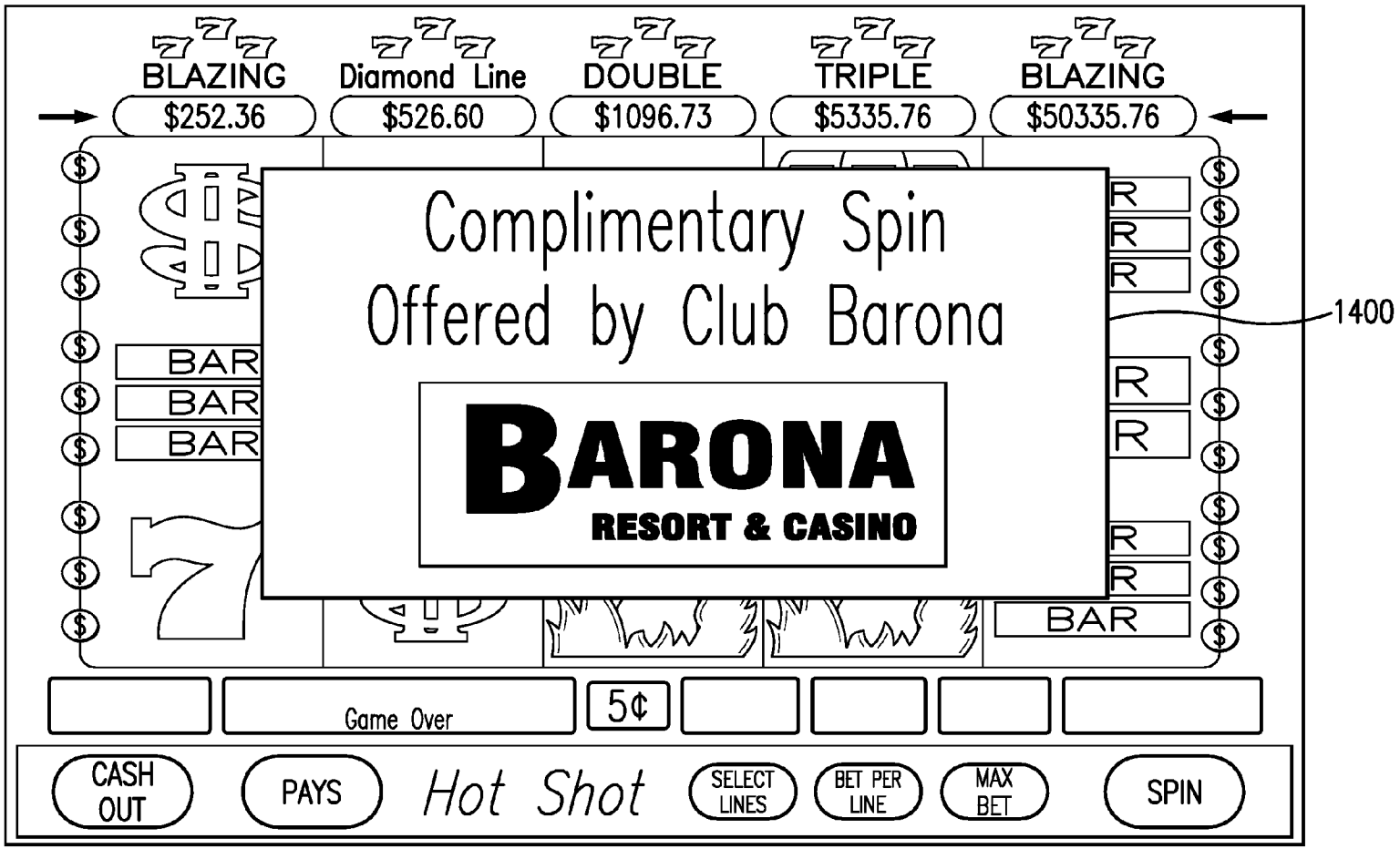
FIGS. 10A and 10B show a sequence of game displays where the bonus is delivered as a sponsored free game.
Figure 10B:
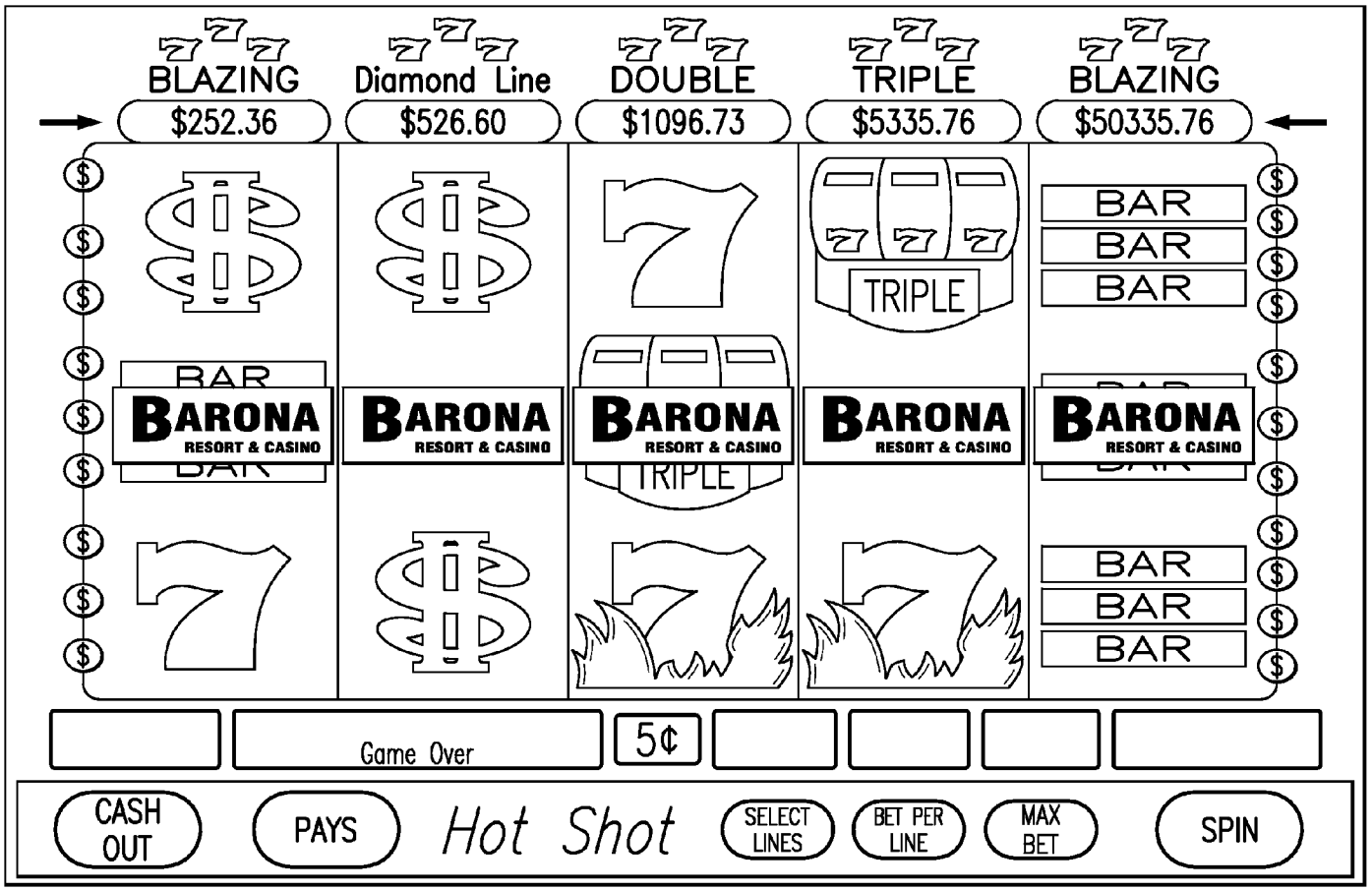

In still an additional embodiment when a bonus is triggered the bonus may be delivered to the terminal by a special game which is presented to the player at the conclusion of the base game play (with any triggered features) and which may be branded by a provider or other advertiser. This embodiment is shown in FIGS. 10A and B. When a system bonus is triggered by any suitable means as herein described the award is either delivered to the gaming terminal ('pushed") or held in queue to be "pulled" by the terminal when the current base game is concluded. For example a player playing a base game may have triggered one or more features such as a free spin set. During the play of the base game or the free game set the bonus may be triggered. In a "push" arrangement the bonus may be sent to the gaming terminal and/or its gaming system interface 1012 and held in queue until completion of the base game and features. When the base game concludes the bonus is delivered to the player by a branded game. As shown in FIG. 11A the main game display 1008 or secondary display 1010 or the display 1014 of the gaming system interface 1014 displays the bonus game with a branding banner 1400 indicating the sponsor of the bonus or other advertising or branding. This enables a third party, e.g. a national airline company for example, to provide funds and brand the bonus for advertising purposes. The third party may provide not only funds but prizes such as airline ticket vouchers or the like. Where the bonus is provided by the casino the branding drives player loyalty. After display of the branding banner 1400 the bonus game is played as shown in FIG. 11B and any bonus awarded to the player. The bonus may be through a series of spins or by another game such as picking a hidden prize, playing a card or wheel or roulette game.

It should be understood that where a bonus amount have been triggered and derived the delivery of the bonus through the game will not necessarily deliver the precise bonus amount. It is intended to deliver approximately the bonus amount. For example where the bonus is delivered through extra free games, the player may receive less than the calculated bonus amount or more than the calculated amount. Any bonus allocated funds not awarded are returned to their pools or to another pool. Any amounts dispensed over the calculated amount are deducted from the pools either on an even basis or based upon a predetermined deduction protocol. Whatever the amount that is actually delivered to the player, it is deducted from the bonus pool(s). The deduction may be based upon a predetermined protocol, i.e. the first 50% deducted from one pool (if there are funds available), then 20% from another pool and so forth. Alternatively the awarded funds may be deducted evenly across the pools.

The foregoing description, for purposes of explanation, uses specific nomenclature and formula to provide a thorough understanding of the invention. It should be apparent to those of skill in the art that the specific details are not required in order to practice the invention. The embodiments have been chosen and described to best explain the principles of the invention and its practical application, thereby enabling others of skill in the art to utilize the invention, and various embodiments with various modifications as are suited to the particular use contemplated. Thus, the foregoing disclosure is not intended to be exhaustive or to limit the invention to the precise forms disclosed, and those of skill in the art recognize that many modifications and variations are possible in view of the above teachings.

What is claimed is:

1. An improved system for funding and issuing a bonus award to a user of a gaming terminal presenting a game having play and award features comprising:

said gaming terminal is dedicated to playing at least one casino wagering game and includes apparatus for at least one of (a) accepting and validating currency or ticket vouchers to establish value for wagering at the gaming terminal and (b) a card reader for reading a player loyalty card to identify the player;

one or more servers including data corresponding to a plurality of fund pools having values V1-VN, at least one fund pool derived from the value of a user's commercial activity unrelated to wagering spend and at least one fund pool derived from a portion of the player's wagers made during play of the terminal;

said one or more servers configured to derive from said pools V1-VN an available bonus fund pool value X;

at least one of said terminal and said one or more servers configured to issue a bonus award from the bonus fund pool X to the user based upon established criteria;

at least one of said terminal and said one or more servers adapted to configure at least one of said terminal to deliver said bonus award to the user through one or more of said game and feature play characteristics and deduct said bonus award amount from X.

2. The system of claim 1 comprising said fund pools include funds derived from one or more of (i) said wagers made during the play of the terminal, (ii) said user's commercial activity unrelated to wagering spend, and (iii) promotional funds.

3. The system of claim 1 comprising at least one of said fund pools V1-VN are is in non-monetary units convertible to a monetary value according to predetermined criteria, said server is configured to determine said bonus pool value X in a standard value selected from one of units or monetary value.

4. The system of claim 1 comprising at least one of said terminal and said one or more servers configured to deduct said award from said bonus pool value X by deducting said bonus award value from at least a plurality of said fund pools V1-VN according to a predetermined protocol.

5. The system of claim 1 comprising one of said terminal and said one or more servers configured to randomly issue said bonus award.

6. The system of claim 1 comprising at least one of said terminal and said one or more servers configured to issue a bonus award to the user based upon established criteria including selecting a plurality of thresholds T1-TN for said bonus fund pool X and for said thresholds randomly determine to issue said bonus award according to different established probability criteria.

7. The system of claim 1 where said terminal includes a free game feature to the user in response to a predetermined event, said improvement comprising configuring at least one of said terminal and said one or more servers to award said bonus award as a package of at least one free game.

8. The system of claim 1 where said terminal has a feature with a plurality of award structures AS1 and AS2 having different expected values, said improvement comprising configuring at least one of said terminal and said one or more servers to randomly select one of said award structures for delivering said determined bonus award.

9. The system of claim 8 where said terminal has a feature with a plurality of award structures AS1 and AS2 having different expected award values of EV1 and EV2 respectively and said selected bonus award is B having a value where EV1<B<EV2, said improvement comprising configuring at least one of said terminal and said one or more servers to randomly select between said award structures.

10. The system of claim 9 comprising configuring at least one of said terminal and said one or more servers to randomly select a value Z between AS1 and AS2 and to select to provide the award through the feature associated with AS2 if EV1≤Z<B and otherwise select the feature associated with AS1.

11. The system of claim 1 comprising said pools are selected from a group consisting of (i) a fund pool derived from a portion of the player's wagers made during play of the terminal, (ii) a pool derived from a hotel loyalty system non-wagering spend, (iii) a pool derived from a food and beverage loyalty system non-wagering spend, (iv) a pool derived from a user's non-wagering retail activities and (iv) a pool derived from marketing and promotional funds.

12. The system of claim 11 comprising said server is configurable to apply a value conversion factor to convert the non-currency value of at least a plurality of said pools to a common bonus pool currency value.

13. The system of claim 1 comprising said one or more servers are configurable to establish bonus award criteria.

14. The system of claim 1 comprising at least one of said terminal and said one or more servers are configured to randomly trigger said bonus with a determined probability of occurrence.

15. The system of claim 14 comprising at least one of said terminal and said one or more servers are configured to randomly trigger said bonus where the bonus award amount relates to the probability of said trigger occurring.

16. The system of claim 1 comprising at least one of said terminal and said one or more servers are configured to issue said bonus amount in a series of at least one of said terminal play and award features.

17. The system of claim 1 comprising at least one of said terminal and said one or more servers are configured to provide a bonus award B between a minimum and a maximum value.

18. The system of claim 17 comprising at least one of said terminal and said one or more servers are configured to randomly select said bonus award.

19. The system of claim 18 comprising at least one of said terminal and said one or more servers are configured to weight the selection of the bonus award toward a predetermined average award.

20. The system of claim 1 comprising at least one of said terminal and said one or more servers are configured to randomly trigger said bonus award based upon at least one criteria.

21. The system of claim 20 comprising at least one of said terminal and said one or more servers are configured to increase the probabilities for triggering said bonus award as said fund pool value X increases in value.

22. The system of claim 20 comprising at least one of said terminal and said one or more servers are configured to base the probabilities for triggering said bonus award in relation to player-centric data including one or more of the gaming terminals played by the player and the game being played by the player.

23. The system of claim 20 comprising at least one of said terminal and said one or more servers are server configured to increase the probabilities for triggering said bonus award as said fund pool value X increases in value.

24. An improved system for funding and issuing a bonus award to a user of a gaming terminal presenting a game having play and award features comprising:

said gaming terminal is dedicated to playing at least one casino wagering game and includes apparatus for at least one of (a) accepting and validating currency or ticket vouchers to establish credits for wagering at the gaming terminal and (b) a card reader for reading a player loyalty card to identify the player;

one or more servers managing a plurality of fund pools having values V1-VN, at least one fund pool derived from the value of a user's commercial activity unrelated to wagering spend and at least one fund pool derived from a portion of the player's wagers made during play of the terminal;

said one or more servers configured to derive from said pools V1-VN an available bonus fund pool value X;

at least one of said terminal and said one or more servers configured to select a bonus award value B from the bonus fund pool X to award to the user based upon established criteria: and at least one of said terminal and said one or more servers configured to deliver said selected bonus award B through a selected one of two award structures AS1 and AS2 having expected values, respectively, of EV1 and EV2 where EV1<EV2 and where if B=EV1 to issue the bonus award according to AV1, if B=EV2 to issue the bonus award according to AV2 and if EV1<B<EV2 to randomly select a value V where EV1≤V≤EV2 and if EV1≤V≤B to issue said bonus award according to AS1 otherwise to issue the bonus award according to AS2.

25. The system of claim 24 wherein said award structure AS1 is a set of N free games and AS2 is a set of N+1 free games.

* * * * *